US006910951B2

(12) United States Patent
Balijepalli et al.

(10) Patent No.: US 6,910,951 B2
(45) Date of Patent: Jun. 28, 2005

(54) MATERIALS AND METHODS FOR CHEMICAL-MECHANICAL PLANARIZATION

(75) Inventors: Sudhakar Balijepalli, Midland, MI (US); Dale J. Aldrich, Lake Jackson, TX (US); Laura A. Grier, Brazoria, TX (US)

(73) Assignee: Dow Global Technologies, Inc., Midland, MI (US)

( * ) Notice: Subject to any disclaimer, the term of this patent is extended or adjusted under 35 U.S.C. 154(b) by 149 days.

(21) Appl. No.: 10/370,781

(22) Filed: Feb. 24, 2003

(65) Prior Publication Data

US 2004/0166779 A1 Aug. 26, 2004

(51) Int. Cl.[7] ..... B24B 1/00

(52) U.S. Cl. ..... 451/41; 451/56; 451/443; 51/395

(58) Field of Search ..... 451/5, 41, 56, 451/9, 10, 285–290, 443, 444; 51/283 R, 401, 395, 244.4; 428/316.6

(56) References Cited

U.S. PATENT DOCUMENTS

| | | | | |
|---|---|---|---|---|
| 3,436,286 A | | 4/1969 | Lange | |
| 4,092,286 A | | 5/1978 | Noll et al. | 260/29.2 |
| 4,237,264 A | | 12/1980 | Noll et al. | 528/67 |
| 4,841,680 A | * | 6/1989 | Hoffstein et al. | 451/42 |
| 5,197,999 A | | 3/1993 | Thomas | 51/298 |
| 5,287,663 A | | 2/1994 | Pierce et al. | 51/401 |
| 5,421,769 A | | 6/1995 | Schultz et al. | 451/287 |
| 5,441,598 A | | 8/1995 | Yu et al. | 156/645.1 |
| 5,510,652 A | | 4/1996 | Burke et al. | 257/752 |
| 5,516,729 A | | 5/1996 | Dawson et al. | 437/228 |
| 5,624,303 A | | 4/1997 | Robinson | 451/285 |
| 5,692,950 A | * | 12/1997 | Rutherford et al. | 451/552 |
| 6,069,080 | | 5/2000 | James et al. | 438/691 |
| 6,095,902 | | 8/2000 | Reinhardt | 451/36 |
| 6,099,393 | | 8/2000 | Katagiri et al. | 451/56 |
| 6,099,394 | * | 8/2000 | James et al. | 451/72 |
| 6,099,954 | | 8/2000 | Urbanavage et al. | 428/314.2 |
| 6,271,276 | | 8/2001 | Gribble et al. | 521/133 |
| 6,302,770 | | 10/2001 | Aiyer | 451/56 |
| 6,306,008 | * | 10/2001 | Moore | 451/5 |
| 6,364,749 | | 4/2002 | Walker | 451/41 |

(Continued)

FOREIGN PATENT DOCUMENTS

| | | |
|---|---|---|
| EP | 0777266 A1 | 6/1977 |
| WO | WO 98/18159 | 4/1998 |
| WO | WO 00/24842 | 5/2000 |
| WO | WO 02/22309 A1 | 3/2002 |

OTHER PUBLICATIONS

Ho–youn Kim et al., "Development of an Abrasive Embedded Pad for Dishing Reduction and Uniformity Enhancement", Journal of the Korean Physical Society, vol. 37, No. 6, Dec. 2000, pp 945–951.

(Continued)

*Primary Examiner*—Lee D. Wilson
*Assistant Examiner*—Anthony Ojini
(74) *Attorney, Agent, or Firm*—Harness, Dickey & Pierce, P.L.C.

(57) ABSTRACT

Provided are materials and methods for the chemical mechanical planarization of material layers such as oxide or metal formed on semiconductor substrates during the manufacture of semiconductor devices using a fixed abrasive planarization pad having an open cell foam structure from which free abrasive particles are produced by conditioning and combined with a carrier liquid to form an in situ slurry on the polishing surface of the planarization pad that, in combination with relative motion between the semiconductor substrate and the planarization pad, tends to remove the material layer from the surface of the semiconductor substrate. Depending on the composition of the material layer, the rate of material removal from the semiconductor substrate may be controlled by manipulating the pH or the oxidizer content of the carrier liquid.

39 Claims, 13 Drawing Sheets

U.S. PATENT DOCUMENTS

| | | | |
|---|---|---|---|
| 6,368,200 | 4/2002 | Merchant et al. | 451/527 |
| 6,387,807 | 5/2002 | Faubert et al. | 438/687 |
| 6,390,890 | 5/2002 | Molnar | |
| 6,390,895 | 5/2002 | Katagiri et al. | 451/56 |
| 6,416,685 | 7/2002 | Zhang et al. | 252/79.1 |
| 6,431,960 | 8/2002 | Walker et al. | 451/41 |
| 6,436,835 | 8/2002 | Kido et al. | 438/693 |
| 6,454,634 | 9/2002 | James et al. | 451/41 |
| 6,458,023 | 10/2002 | Moon | 451/526 |
| 6,468,911 | 10/2002 | Miyashita et al. | 438/692 |
| 6,475,069 | 11/2002 | Thomas et al. | 451/57 |
| 6,477,825 | 11/2002 | Katagiri et al. | 56/451 |
| 6,478,659 | 11/2002 | Peng et al. | 451/8 |
| 6,485,356 | 11/2002 | Sabde et al. | 451/41 |
| 6,514,301 | 2/2003 | Lombardo | |
| 6,524,961 | 2/2003 | Katagiri et al. | 438/691 |
| 6,537,137 | 3/2003 | Oliver | 451/41 |
| 2001/0053660 | 12/2001 | Koinkar et al. | 451/56 |
| 2002/0004357 | 1/2002 | Baker, III et al. | 451/41 |
| 2002/0052064 | 5/2002 | Grabbe et al. | |
| 2002/0072307 | 6/2002 | Fruitman et al. | 451/36 |
| 2002/0076931 | 6/2002 | Plat et al. | 438/689 |
| 2002/0098701 | 7/2002 | Hasegawa | 438/692 |

OTHER PUBLICATIONS

Alexander Simpson et al., "Fixed Abrasive Technology for STI CMP on a Web Format Tool", Mat. Res. Soc. Symp. Proc. vol. 671 (2001) Materials Research Society, pp 1–9.

Dipto G. Thakurta et al., "Pad porosity, compressibility and slurry delivery effects in chemical–mechanical planarization modeling and experiments", Thin Solid Films 366 (2000) pp 181–190.

B.J. Hooper et al., "Pad conditioning in chemical mechanical polishing", Journal of Materials Processing Technology 123 (2002) pp 107–113.

P. van der Velden, "Chemical mechanical polishing with fixed abrasives using different subpads to optimize wafer uniformity", Microelectronic Engineering 50 (2000) pp 41–46.

* cited by examiner

MATERIALS AND METHODS FOR CHEMICAL-MECHANICAL PLANARIZATION

TECHNICAL FIELD

The present invention relates generally to materials and methods for planarizing semiconductor substrates and, in particular, to fixed abrasive materials suitable for use in planarizing pads and methods of removing process material layers from the surface of semiconductor substrates using such pads.

BACKGROUND

Ultra large scale integrated (ULSI) semiconductor devices, such as dynamic random access memories (DRAMs) and synchronous dynamic random access memories (SDRAMs), consist of multiple layers of conducting, semiconducting, and insulating materials, interconnected within and between layers in specific patterns designed to produce desired electronic functionalities. The materials are selectively patterned on each layer of the device, using lithographic techniques, involving masking and etching the materials. This is a very precise process, particularly as the size of the device structures continues to decrease and the complexity of the circuits continues to increase. Height differences, pitch and reflectivity variations and other imperfections present in the surface of underlying layers may compromise the formation of additional process layers and/or the ability to precisely position and dimension photoresist patterns formed during subsequent lithography processes.

A variety of methods have been developed in the art so as to increase the planarity of the layers during the manufacturing process. Such methods include reflow processes with deposited oxides, spin-on-glass (SOG) processes, etchback processes and Chemical-Mechanical Planarization (CMP) processes (also referred to as Chemical-Mechanical Polishing). CMP processes have been developed for removing a wide variety of materials including oxides, nitrides, silicides and metals from the surface of a semiconductor substrate. As used herein, the terms planarization and polishing are intended to be mutually inclusive terms for the same general category of processes.

A variety of different machine configurations have been developed for performing the various CMP processes. Machines used for CMP processing can be broadly grouped into either web-feed or fixed-pad categories. In both categories, however, the basic process uses a combination of a planarizing pad and a planarizing liquid to remove material from the surface of a semiconductor substrate using primarily mechanical action or through a combination of chemical and mechanical action.

The planarizing pads, in turn, can be broadly grouped into fixed-abrasive (FA) or non-abrasive (NA) categories. In fixed-abrasive pads, abrasive particles are distributed in material that forms at least a portion of the planarizing surface of the pad, while non-abrasive pad compositions do not include any abrasive particles. Because the fixed-abrasive pads already include abrasive particles, they are typically used in combination with a "clean" planarizing liquid that does not add additional abrasive particles. With non-abrasive pads, however, substantially all of the abrasive particles used in the planarizing process are introduced as a component of the planarizing liquid, typically as a slurry applied to the planarizing surface of the pad. Both the "clean" and abrasive planarizing liquids can also include other chemical components, such as oxidizers, surfactants, viscosity modifiers, acids and/or bases in order to achieve the desired liquid properties for the removal of the targeted material layer from the semiconductor substrate and/or to provide lubrication for decreasing defectivity rates.

CMP processes typically utilize a combination of mechanical abrasion and chemical reaction(s) provided by the action of the planarizing slurry or planarizing liquid and a planarizing pad in order to remove one or more materials from a wafer surface and produce a substantially planar wafer surface. Planarizing slurries used in combination with non-abrasive pads, particularly for the removal of oxide layers, generally comprise a basic aqueous solution of a hydroxide, such as KOH, containing abrasive silica particles. Planarizing slurries, particularly for the removal of metal layers such as copper, generally comprise an aqueous solution of one or more oxidizers, such as hydrogen peroxide, to form the corresponding metal oxide that is then removed from the substrate surface.

The planarizing pads used in such processes typically comprise porous or fibrous materials, such as polyurethanes, that provide a relatively compliant surface onto which the planarizing slurry may be dispensed. The consistency of a CMP process may be greatly improved by automating the process so that the planarizing is terminated in response to a consistently measurable endpoint reflecting sufficient removal of an overlying material layer, typically followed by a brief "overetch" or "over-polish" to compensate for variations in the thickness of the material layer.

The size and concentration of the particles for planarizing a wafer surface can directly affect the resulting surface finish and the productivity of a CMP process. For example, if the abrasive particulate concentration is too low or the abrasive particle size too small, the material removal rate will generally slow and process throughput will be reduced. Conversely, if the abrasive particulate concentration is too high, the abrasive particles are too large or the abrasive particles begin to agglomerate, the wafer surface is more likely to be damaged, the CMP process may tend to become more variable and/or the material removal rate may decrease, resulting in reduced throughput, reduced yields or device reliability and/or increased scrap.

CMP processes may experience significant performance variations over time that further complicate processing of the wafers and reduce process throughput. In many cases, the performance variations may be attributable to changes in the characteristics of the planarizing pad as a result of the CMP process itself. Such changes may result from particulates agglomerating and/or becoming lodged in or hardening on the pad surface. Such changes may also be the result of wear, glazing or deformation of the pad, or simply the degradation of the pad material over time.

In a typical planarizing process, the planarizing machine brings the non-planar surface of a material layer formed over one or more patterns on a semiconductor substrate into contact with a planarizing surface of the planarizing pad. During the planarizing process, the surface of the planarizing pad will typically be continuously wetted with an abrasive slurry and/or a planarizing liquid to produce the desired planarizing surface. The substrate and/or the planarizing surface of the pad are then urged into contact and moved relative to one another to cause the planarizing surface to begin removing an upper portion of the material layer. This relative motion can be simple or complex and may include one or more lateral, rotational, revolving or orbital movements by the planarizing pad and/or the substrate in order to produce generally uniform removal of the material layer across the surface of the substrate.

As used herein, lateral movement is movement in a single direction, rotational movement is rotation about an axis through the center point of the rotating object, revolving movement is rotation of the revolving object about a non-centered axis and orbital movement is rotational or revolving movement combined with an oscillation. Although, as noted above, the relative motion of the substrate and the planarizing pad may incorporate different types of movement, the motion must typically be confined to a plane substantially parallel to the surface of substrate in order to achieve a planarized substrate surface.

Fixed abrasive pad types are known in the art of semiconductor wafer processing and have been disclosed in, for example, U.S. Pat. No. 5,692,950 to Rutherford et al.; U.S. Pat. No. 5,624,303 to Robinson; and U.S. Pat. No. 5,335,453 to Baldy et al. These types of fixed abrasive pads typically require a pre-conditioning cycle before they may be used in a CMP process, as well as periodic re-conditioning or in-situ surface conditioning during use, to generate a suitable number of asperities on the planarizing surface to maintain their planarizing ability.

The primary goal of CMP processing is to produce a defect-free planarized substrate surface having a material layer, or portions of a material layer, of uniform depth across the entire surface of the planarized substrate. Other goals, such as maximizing the throughput of the CMP process and reducing the per wafer cost, may, at times, conflict with the production of the best possible planarized surface. The uniformity of the planarized surfaces and the process throughput are directly related to the effectiveness and repeatability of the entire CMP process including the planarizing liquid, the planarizing pad, machine maintenance, as well as an array of other operating parameters. A variety of planarizing slurries and liquids have been developed that are somewhat specific to the composition of the material layer or layers that are to be removed and/or the composition of the planarizing pad being used. These tailored slurries and liquids are intended to provide adequate material removal rates and selectivity for particular CMP processes.

The benefits of CMP may be somewhat offset by the variations inherent in such a combination process, such as imbalances that may exist or may develop between the chemical and mechanical material removal rates of different material layers exposed on a single semiconductor substrate. Further, both the abrasive particles and other chemicals used in a typical CMP process may be relatively expensive and are generally unsuitable for reuse or recycling. This problem is compounded by the need to supply excess materials to the surface of the planarization pad to ensure that sufficient material is available at every point of the wafer surface as it moves across the pad. It is therefore desirable to reduce the quantity of abrasives and other chemicals used in a CMP process in order to reduce costs associated with both purchasing and storing the materials prior to use and the concerns and expense relating to the disposal of the additional waste materials.

A number of efforts toward reducing the variability and increasing the quality of CMP processes have been previously disclosed. For instance, U.S. Pat. No. 5,421,769 to Schultz et al. discloses a noncircular planarizing pad intended to compensate for variations resulting from the edges of a rotating wafer traveling across more of a planarizing pad than the interior surfaces. U.S. Pat. No. 5,441,598 to Yu et al. discloses a planarizing pad having a textured planarizing surface for providing a planarizing surface intended to provide more even polishing of wide and narrow structures across a wafer surface. U.S. Pat. No. 5,287,663 to Pierce et al. discloses a composite planarizing pad with a rigid layer opposite the planarizing surface and a resilient layer adjacent the rigid layer to reduce overplanarization, or "dishing," of material from between harder underlying features.

Other prior art efforts to minimize uneven planarization of wafers have focused on forming additional material layers on the wafer surface to act as "stop" layers to control overplanarization. U.S. Pat. Nos. 5,356,513 and 5,510,652 to Burke et al. and U.S. Pat. No. 5,516,729 to Dawson et al. all provide additional material layers having an increased resistance to the CMP process under the layer being removed to protect the underlying circuit structures. These additional material layers, however, both complicate the semiconductor manufacturing process flow and, as recognized by Dawson et al., do not completely overcome the problem of "dishing."

More recent efforts regarding planarizing pad compositions and constructions are disclosed in U.S. Pat. No. 6,425,815 B1 to Walker et al. (a dual material planarizing pad), U.S. Pat. No. 6,069,080 to James et al. (a fixed abrasive pad with a matrix material having specified properties), U.S. Pat. No. 6,454,634 B1 to James et al. (a multiphase self-dressing planarizing pad), WO 02/22309 A1 to Swisher et al. (a planarizing pad having particulate polymer in a cross-linked polymer binder), U.S. Pat. No. 6,368,200 B1 to Merchant et al. (a planarizing pad of a closed cell elastomer foam), U.S. Pat. No. 6,364,749 B1 to Walker (planarizing pad having polishing protrusions and hydrophilic recesses), U.S. Pat. No. 6,099,954 to Urbanavage et al. (elastomeric compositions with fine particulate matter) and U.S. Pat. No. 6,095,902 to Reinhardt (planarization pads manufactured from both polyester and polyether polyurethanes).

Each of the above references, in its entirety, is incorporated by reference in this disclosure.

BRIEF SUMMARY OF THE INVENTION

The present invention provides materials and methods useful in the manufacture of semiconductor devices, specifically materials and methods for planarizing one or more layers deposited or formed on a semiconductor substrate, comprising

- applying a carrier liquid to the polishing surface of a polishing pad, the polishing pad having an open cell structure of a thermoset polymer matrix defining a plurality of interconnected cells and abrasive particles distributed throughout the polymer matrix;
- causing relative motion between the substrate and the polishing pad in a plane generally parallel to the major surface of the substrate while applying a force tending to bring the major surface and the polishing surface into contact;
- conditioning the polishing surface, thereby releasing abrasive particles from the polymer matrix to form free abrasive particles; and
- polishing the major surface of the substrate with the free abrasive particles to remove a portion of the material from the major surface of the substrate.

Preferably, the polishing pad comprises a fixed abrasive material having an open cell foam structure containing between about 5 and 85 wt % abrasive particles and a dry bulk density of between about 350 kg/m$^3$ to 1200 kg/m$^3$ (about 21.8–75 lbs/ft$^3$).

It has been found that the methods of this invention afford benefits over methods among those known in the art, including improvements in one or more of improved ability to control the planarization process, increased uniformity of the planarized surface produced, reduced cost and increased throughput.

It should be noted that the graphs and illustrations of the Figures are intended to show the general characteristics of methods and materials of exemplary embodiments of this invention, for the purpose of the description of such embodiments herein. These graphs and illustrations may not precisely reflect the characteristics of any given embodiment, and are not necessarily intended to fully define or limit the range of values or properties of embodiments within the scope of this invention.

DETAILED DESCRIPTION OF THE INVENTION

Described below and illustrated in the accompanying drawings are certain exemplary embodiments according to the invention. These exemplary embodiments are described in sufficient detail to enable those of skill in the art to practice the invention, but are not to be construed as unduly limiting the scope of the following claims. Indeed, those of skill in the art will appreciate that other embodiments may be utilized and that process or mechanical changes may be made without departing from the spirit and scope of the inventions as described.

The present invention provides methods useful in the production of semiconductor devices. As referred to herein, such devices include any wafer, substrate or other structure comprising one or more layers comprising conducting, semiconducting, and insulating materials. The terms wafer and substrate are used herein in their broadest sense and include any base semiconductor structure such as metal-oxide-silicon (MOS), shallow-trench isolation (STI), silicon-on-sapphire (SOS), silicon-on-insulator (SOI), thin film transistor (TFT), doped and undoped semiconductors, epitaxial silicon, III–V semiconductor compositions, polysilicon, as well as other semiconductor structures at any stage during their manufacture. (As used herein, the word "include," and its variants, is intended to be non-limiting, such that recitation of items in a list is not to the exclusion of other similar, corresponding or equivalent items that may also be useful in the materials, compositions, devices, and methods of this invention.)

Figure 1A:
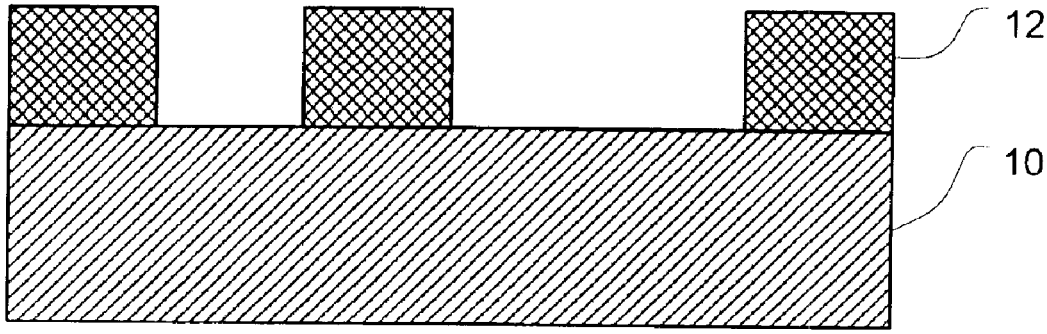
FIGS. 1A–C are cross-sectional views of a semiconductor substrate with a raised pattern, a material layer formed over the pattern, and the planarized substrate at sequential processing stages in accordance with an exemplary embodiment of the invention.
Figure 1B:
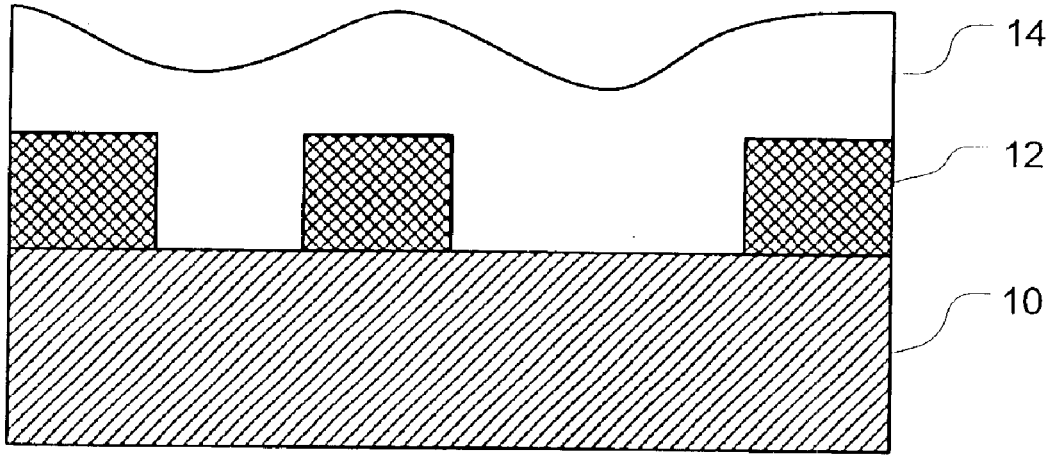

FIG. 1A illustrates a typical substrate 1 having a first layer 10 and a patterned second layer 12. In typical semiconductor processing, first layer 10 may comprise a wafer of single-crystal silicon or other base semiconductor layer, an insulating layer separating second patterned layer 12 from other layers, or a combination of multiple layers formed during previous processing steps. As illustrated in FIG. 1B, a material layer 14, which may actually comprise multiple layers of one or more materials, is then typically formed or deposited over the patterned layer 12, producing a non-planar surface on the wafer.

Figure 1C:
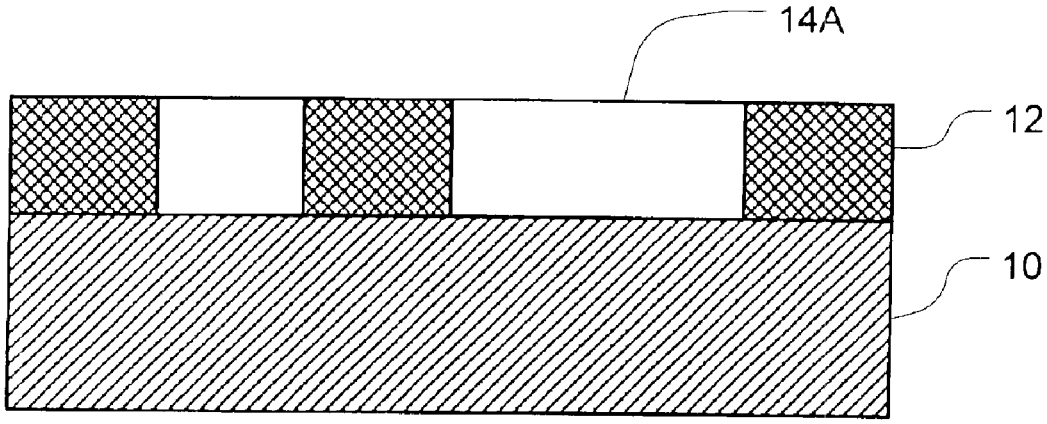

If allowed to remain, this lack of planarity would present significant, if not fatal, process complications during subsequent processing steps. As a result, most, if not all, semiconductor manufacturing processes include one or more planarization processes such as spin-on-glass (SOG), etchback (or blanket etch) or chemical-mechanical planarization (CMP) in order to form a substantially planar surface before the wafer is subjected to additional processing. A typical CMP process will remove that portion of material layer 14 that lies over the patterned layer 12 while leaving that portion 14A of the material layer 14 that was deposited in the openings of patterned layer 12 to produce a substantially more planar surface as illustrated in FIG. 1C. Depending on the process, a stop layer comprising a more CMP resistant material may be incorporated on the upper surface of the patterned layer 12 to protect the underlying pattern during the planarization process. The actual composition and structure of the first layer 10, second layer 12 and the material layer 14 may comprise any combination of semiconductor, insulator or conductor materials assembled during the manufacture of a semiconductor device.

Figure 2A:
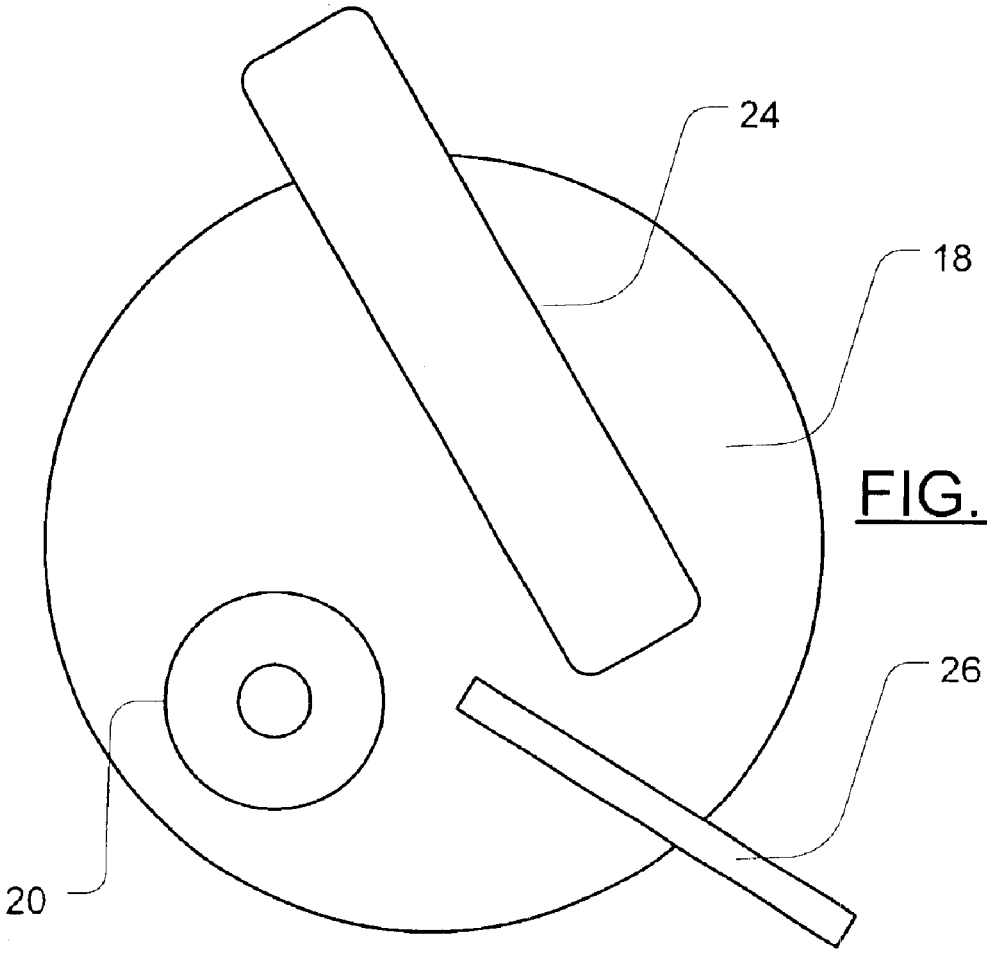
FIGS. 2A–B are a plan view and a side view of a planarization apparatus that may be used for planarizing substrates using planarizing pads according to an exemplary embodiments of the invention.
Figure 2B:
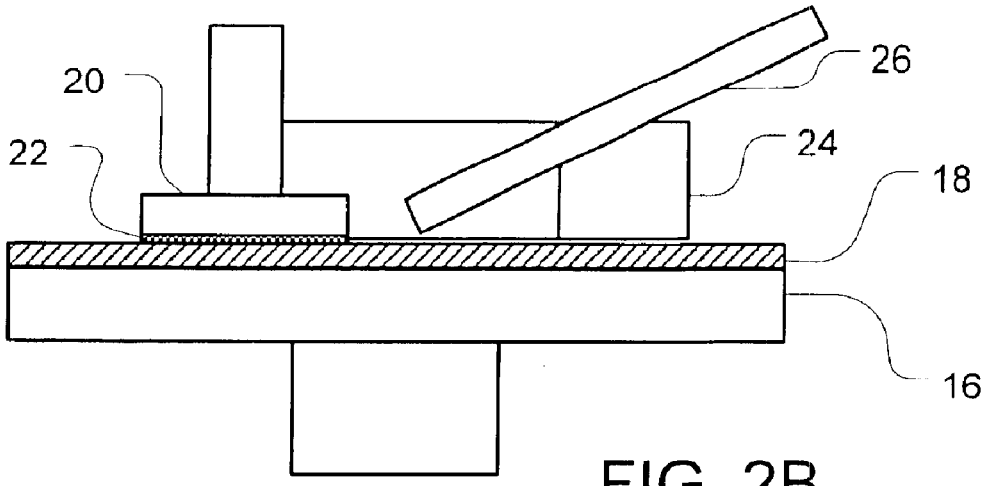

As illustrated in FIGS. 2A–B, a typical CMP apparatus for use with a fixed abrasive planarization pad will comprise at least a platen 16 supporting the planarizing pad 18, a wafer carrier 20 supporting a wafer 22 and positioning a major surface of the wafer adjacent a major surface of the planarizing pad 18, and a conditioning device 24 for conditioning the major surface of the planarizing pad and a carrier liquid supply line 26 for applying a carrier liquid to the major surface of the pad. The platen 16 and the wafer carrier 20 are configured to provide relative motion between the major surface of the planarizing pad 18 and the major surface of the wafer 22 while applying a force tending to move the wafer and the planarizing pad against each other.

Polishing Pads:

The methods of this invention comprise the use of a polishing pad comprising a fixed abrasive material. Such fixed abrasive materials have an open cell structure of a thermoset polymer matrix defining a plurality of interconnected cells and abrasive particles distributed throughout the polymer matrix. A fixed abrasive material useful in the present invention is preferably manufactured from a polymeric composition comprising an aqueous dispersion or emulsion of one or more compositions such as polyurethanes, polyether polyols, polyester polyols, polyacrylate polyols and polystyrene/polyacrylate latexes. The polymeric composition may also include one or more additives including polymerization catalysts, chain extenders, including amines and diols, isocyanates, both aliphatic and aromatic, surfactants and viscosity modifiers. (As used herein, the words "preferred" and "preferably" refer to embodiments of the invention that afford certain benefits, under certain circumstances. However, other embodiments may also be preferred, under the same or other circumstances. Furthermore, the recitation of one or more preferred embodiments does not imply that other embodiments are not useful and is not intended to exclude other embodiments from the scope of the invention.)

An exemplary embodiment of a polyurethane dispersion useful for manufacturing a fixed abrasive material includes water, abrasive particles and a polyurethane (and/or a mixture capable of forming a polyurethane). The polyurethane dispersion will generally also include one or more additives such as surfactants, that may act as frothing aids, wetting agents and/or foam stabilizers, and viscosity modifiers. Polyurethane-forming materials may include, for example, polyurethane prepolymers that retain some minor isocyanate reactivity for some period of time after being dispersed, but as referenced herein, a polyurethane prepolymer dispersion will have reacted substantially completely to form a polyurethane polymer dispersion. Also, the terms polyurethane prepolymer and polyurethane polymer may encompass other types of structures such as, for example, urea groups.

Polyurethane prepolymers may be prepared by reacting active hydrogen compounds with an isocyanate, typically with a stoichiometric excess of the isocyanate. The polyurethane prepolymers may exhibit isocyanate functionality in an amount from about 0.2 to 20%, may have a molecular weight in the range of from about 100 to about 10,000, and are typically in a substantially liquid state under the conditions of the dispersal.

The prepolymer formulations typically include a polyol component, e.g., active hydrogen containing compounds having at least two hydroxyl or amine groups. Exemplary polyols are generally known and are described in such publications as *High Polymers*, Vol. XVI, "Polyurethanes, Chemistry and Technology," Saunders and Frisch, Interscience Publishers, New York, Vol. I, pp. 32–42, 44–54 (1962) and Vol. II, pp. 5–6, 198–199 (1964); *Organic Polymer Chemistry*, K. J. Saunders, Chapman and Hall, London, pp. 323–325 (1973); and *Developments in Polyurethanes*, Vol. I, J. M. Burst, ed., Applied Science Publishers, pp. 1–76 (1978). Active hydrogen containing compounds that may be used in the prepolymer formulations also include, alone or in an admixture, polyols comprising: (a) alkylene oxide adducts of polyhydroxyalkanes; (b) alkylene oxide adducts of non-reducing sugars and sugar derivatives; (c) alkylene oxide adducts of phosphorus and polyphosphorus acids; and (d) alkylene oxide adducts of polyphenols. These types of polyols may be generally referred to herein as "base polyols."

Examples of useful alkylene oxide adducts of polyhydroxyalkanes include adducts of ethylene glycol, propylene glycol, 1,3-dihydroxypropane, 1,4-dihydroxybutane, and 1,6-dihydroxyhexane, glycerol, 1,2,4-trihydroxybutane, 1,2,6-dihydroxyhexane, 1,1,1-trimethylolethane, 1,1,1-trimethylolpropane, pentaerythritol, polycaprolactone, xylitol, arabitol, sorbitol, mannitol. Other useful alkylene oxide adducts of polyhydroxyalkanes include the propylene oxide adducts and ethylene oxide capped propylene oxide adducts of dihydroxy- and trihydroxyalkanes. Yet other useful alkylene oxide adducts include adducts of ethylene diamine, glycerin, piperazine, water, ammonia, 1,2,3,4-tetrahydroxy butane, fructose, sucrose. Also useful are poly(oxypropylene) glycols, triols, tetrols and hexols and any of these compounds capped with ethylene oxide including poly(oxypropyleneoxyethylene)polyols. If present, the oxyethylene content may comprise between about 40 and about 80 wt % of the total polyol. Ethylene oxide, when used, may be incorporated in any way along the polymer chain, for example, as internal blocks, terminal blocks, randomly distributed blocks or any combination thereof.

Polyester polyols may also be used in preparing a polyurethane dispersion. Polyester polyols are generally characterized by repeating ester units, which can be aromatic or aliphatic, and by the presence of terminal primary or secondary hydroxyl groups, although many polyesters terminating in at least two active hydrogen groups may be used. For example, the reaction product of the transesterification of glycols with poly(ethylene terephthalate) may be used to prepare polyurethane dispersions. Other components useful in preparing a polyurethane dispersion include polyols having acrylic groups or amine groups, acrylate prepolymers, acrylate dispersions and hybrid prepolymers.

Preferably at least 50 wt % of the active hydrogen compounds used in preparing the polyurethane or polyurethane prepolymer is one or more polyether polyols having molecular weights of from about 600 to 20,000, more preferably from about 1,000 to 10,000 and most preferably from about 3,000 to 8,000, that also exhibit a hydroxyl functionality of at least 2.2, preferably between about 2.2 to 5.0, more preferably from about 2.5 to 3.8 and most preferably from about 2.6 to 3.5. As used herein, hydroxyl functionality is defined as the average calculated functionality of all polyol initiators after adjustment for any known side reactions which may affect functionality during polyol production.

The polyisocyanate component of the polyurethane or prepolymer formulations may include one or more organic polyisocyanates, modified polyisocyanates, isocyanate based prepolymers, or mixtures thereof. The polyisocyanates may include aliphatic and cycloaliphatic isocyanates, but aromatic, and especially multifunctional aromatic isocyanates, such as 2,4- and 2,6-toluenediisocyanate and the corresponding isomeric mixtures; 4,4'-, 2,4'- and 2,2'-diphenyl-methanediisocyanate (MDI) and the corresponding isomeric mixtures; mixtures of 4,4'-, 2,4'- and 2,2'-diphenylmethanediisocyanates and polyphenyl polymethylene polyisocyanates (PMDI); and mixtures of PMDI and toluene diisocyanates are preferred. Most preferably, the polyisocyanate used to prepare the prepolymer formulation of the present invention is MDI, PMDI or a mixture thereof.

The polyurethane prepolymers may include a chain extender or crosslinker. A chain extender is used to build the molecular weight of the polyurethane prepolymer by reaction of the chain extender with the isocyanate functionality in the polyurethane prepolymer, i.e., "chain extend" the polyurethane prepolymer. Suitable chain extenders and crosslinkers typically comprise a low equivalent weight active hydrogen containing compound having two or more active hydrogen groups per molecule. Chain extenders typically include at least two active hydrogen groups and crosslinkers typically include at least three active hydrogen groups such as hydroxyl, mercaptyl, or amino groups. Amine chain extenders may be blocked, encapsulated, or otherwise rendered less reactive. Other materials, particularly water, may also extend chain length and, therefore, may also be used as chain extenders in the polyurethane prepolymer formulation.

Polyamines are preferred as chain extenders and/or crosslinkers, particularly amine terminated polyethers such as, for example, JEFFAMINE D-400 from Huntsman Chemical Company, aminoethyl piperazine, 2-methyl piperazine, 1,5-diamino-3-methyl-pentane, isophorone diamine, ethylene diamine, diethylene triamine, aminoethyl ethanolamine, triethylene tetraamine, triethylene pentaamine, ethanol amine, lysine in any of its stereoisomeric forms and salts thereof, hexane diamine, hydrazine and piperazine. The chain extender may be used as an aqueous solution and may be present in an amount sufficient to react with up to 100 percent of the isocyanate functionality present in the prepolymer, based on one equivalent of isocyanate reacting with one equivalent of chain extender. Water may act as a chain extender and react with some or all of the isocyanate functionality present. A catalyst may also be included to promote the reaction between a chain extender and an isocyanate and chain extenders having three or more active hydrogen groups may also concurrently function as crosslinkers.

Catalysts suitable for use in preparing the polyurethanes and polyurethane prepolymers utilized in the present invention include, for example, tertiary amines, organometallic compounds and mixtures thereof. For example, suitable catalysts include di-n-butyl tin bis(mercaptoacetic acid isooctyl ester), dimethyltin dilaurate, dibutyltin dilaurate, dibutyltin sulfide, stannous octoate, lead octoate, ferric acetylacetonate, bismuth carboxylates, triethylenediamine, N-methyl morpholine, and mixtures thereof. The addition of a catalyst may decrease the time necessary to cure the polyurethane prepolymer dispersion to a tack-free state and may utilize a quantity of catalyst from about 0.01 to about 5 parts per 100 parts by weight of the polyurethane prepolymer.

Surfactants useful in the dispersion may include cationic surfactants, anionic surfactants or non-ionic surfactants. Anionic surfactants include, for example, sulfonates, carboxylates, and phosphates, cationic surfactants include quaternary amines and non-ionic surfactants include block copolymers containing ethylene oxide, propylene oxide, butylene oxide, or a combination thereof and silicone surfactants. Surfactants useful herein include external surfactants, i.e., surfactants that do not chemically react with the polymer during dispersion preparation, such as salts of dodecyl benzene sulfonic acid, and lauryl sulfonic acid. Surfactants useful herein also include internal surfactants, that may chemically react with the polymer during dispersion preparation, such as 2,2-dimethylol propionic acid (DMPA) and its salts or sulfonated polyols neutralized with ammonium chloride. The surfactant or surfactants may be included in the polyurethane dispersion in an amount ranging from about 0.01 to about 20 parts per 100 parts by weight of polyurethane component. The selection and use of surfactant compositions in polyurethane dispersions is addressed in U.S. Pat. No. 6,271,276, the contents of which are incorporated herein, in their entirety, by reference.

A polyurethane dispersion having a mean particle size of less than about 5 microns may be generally considered to be shelf-stable or storage-stable while polyurethane dispersions having a mean particle size greater than about 5 microns will tend to be less stable. Polyurethane dispersions may be prepared by mixing a polyurethane prepolymer with water and dispersing the prepolymer in the water using a mixer. Alternatively, the polyurethane dispersion may be prepared by feeding a prepolymer and water into a static mixing device, and dispersing the water and prepolymer in the static mixer. Continuous methods for preparing aqueous dispersions of polyurethane are also known as disclosed in, for example, U.S. Pat. Nos. 4,857,565; 4,742,095; 4,879,322; 3,437,624; 5,037,864; 5,221,710; 4,237,264; 4,092,286 and 5,539,021, the contents of which are incorporated herein, in their entirety, by reference.

A polyurethane dispersion useful for forming an abrasive pad will generally include a polyurethane component, abrasive particles, and one or more surfactants to control the frothing and stabilize the resulting foam to produce a cured foam having a density between 350 kg/m$^3$ and 1200 kg/m$^3$ while maintaining desired foam properties like abrasion resistance, tensile, tear, and elongation (TTE), compression set, foam recovery, wet strength, toughness, and adhesion. As will be appreciated by those of ordinary skill in the art, because certain of these various properties are interrelated, modifying one property will tend to effect the values of one or more of the other properties. One skilled in the art, however, guided by this disclosure can produce a range of compositions having a combination of values acceptable for various purposes. Although the cured foam may have a density of between about 350 kg/m$^3$ and 1200 kg/m$^3$, preferred foams will have a density of about 600–1100 kg/m$^3$, more preferred foams will have a density of about 700–1000 kg/m$^3$ and most preferred foams will have a density of about 750–950 kg/m$^3$.

As noted above, surfactants may be useful in preparing the polyurethane dispersion and may also be useful in preparing a froth from the dispersion. Surfactants useful for preparing a froth are referred to herein as frothing surfactants and typically act by allowing the frothing agent, typically a gas and commonly air, used in the frothing process to disperse more homogenously and efficiently throughout the polyurethane dispersion. Frothing surfactants may be selected from a variety of anionic, cationic and zwitterionic surfactants and preferably, after curing, provide a non-sudsing foam. A commonly used anionic surfactant, sodium lauryl sulfate, for instance is less preferred because of a tendency to cause some post-cure sudsing in the final foam product.

Preferred frothing surfactants include carboxylic acid salts represented by the general formula:

$$RCO_2^-X^+ \quad \text{(I)},$$

where R represents a $C_8$–$C_{20}$ linear or branched alkyl, which may contain an aromatic, a cycloaliphatic, or heterocycle; and X is a counter ion, generally Na, K, or an amine, such as $NH_4^+$, morpholine, ethanolamine, or triethanolamine. Preferably R represents a $C_{10}$–$C_{18}$ linear or branched alkyl, and more preferably a $C_{12}$–$C_{18}$ linear or branched alkyl. The surfactant may include a number of different R species, such as a mixture of $C_8$–$C_{20}$ alkyl salts of fatty acids. Amines are preferred and ammonium salts, such as ammonium stearate, are more preferred as the counter ion, X, in the surfactants. The amount of frothing surfactant(s) used may be based on the dry solids content in the surfactant relative to polyurethane dispersion solids in parts per hundred. Generally, between about 1 and 20 parts of dry frothing surfactant may be used per 100 parts of polyurethane dispersion, although between 1 and 10 parts is preferred.

Surfactants may also be useful for stabilizing the polyurethane froth and are referred to herein generally as stabilizing surfactants. Stabilizing surfactants may be based on sulfonic acid salts, such as sulfates including alkylbenzenesulfonates, succinamates, and sulfosuccinamates. Preferred sulfates are sulfosuccinate esters that may be represented by the general formula:

$$R^2OOCCH_2CH(SO_3^-M^+)COOR^3 \quad \text{(II)},$$

where $R^2$ and $R^3$ each represent a $C_6$–$C_{20}$ linear or branched alkyl, which can contain an aromatic, a cycloaliphatic and where M represents is a counter ion, generally ammonia or an element from group 1A of the Periodic Table, such as lithium, potassium, or sodium. Preferably $R^2$ and $R^3$ each represent a different or identical $C_8$–$C_{20}$ linear or branched alkyl and, more preferably, a $C_{10}$–$C_{18}$ linear or branched alkyl. The surfactant may include a number of different $R^2$ and $R^3$ species, with amines being preferred and ammonium salts being more preferred. Salts of octadecyl sulfosuccinates are also preferred. Generally, between about 0.01 and 20 parts of dry stabilizing surfactant may be used per 100 parts of polyurethane dispersion, although between about 0.1 and 10 parts is preferred.

In addition to one or more of the anionic surfactants described above, the polyurethane dispersion may also include a zwitterionic surfactant to enhance frothing and/or stability of the froth. Suitable zwitterionic sufactants include N-alkylbetaines and beta-alkylproprionic acid derivatives. N-alkylbetaines may be represented by the general formulas:

$$R^4N^+(CH_3)_2CH_2COO^-M^+ \quad \text{(III)},$$

$$R^4N^+Cl^-M+ \text{ or} \quad \text{(IV)},$$

$$R^4N^+Br^-M^+ \quad \text{(V)},$$

where $R^4$ is a $C_6$–$C_{20}$ linear or branched alkyl, which can contain an aromatic, a cycloaliphatic and M are as described above. One or more zwitterionic surfactants may be included in the polyurethane dispersion at up to about 10 parts of dry zwitterionic surfactant per 100 parts of polyurethane dispersion, and preferably between about 0.05 to 4 parts of dry surfactant.

In addition to the surfactants specifically listed above, other surfactants may be included in the polyurethane dispersion in order to achieve the desired frothing and foam stability. In particular, additional anionic, zwitterionic or nonionic surfactants may be used in combination with the above listed surfactants.

The polyurethane dispersion also comprises one or more abrasive particulate compositions. Such abrasive compositions may be either a dry powder or an aqueous slurry to produce a final polyurethane dispersion composition comprising between about 1 and 80 wt %, and more preferably between about 20 and 70 wt %, of the abrasive particulates. The abrasive particulates may comprise one or more fine abrasive materials, typically one or more inorganic oxides selected from a group consisting of silica, ceria, alumina, zirconia and titania and have an average particle size of between about 10 nm and 1 $\mu$m, preferably less than about 600 nm.

The polyurethane dispersion and/or the abrasive material may also include a wetting agent for improving the compatibility and dispersability of the abrasive particles throughout the polyurethane dispersion. Wetting agents may include phosphate salts such as sodium hexametaphosphate and may be present in the polyurethane dispersion at a concentration of up to 3 parts per 100 parts of polyurethane dispersion.

The polyurethane dispersion may also include viscosity modifiers, particularly thickeners, to adjust the viscosity of the polyurethane dispersion. Such viscosity modifiers include ACUSOL 810A (trade designation of Rohm & Haas Company), ALCOGUM™ VEP-II (trade designation of Alco Chemical Corporation) and PARAGUM™ 241 (trade designation of Para-Chem Southern, Inc.). Other suitable thickeners include cellulose ethers such as Methocel™ products (trade designation of The Dow Chemical Company). The viscosity modifiers may be present in the polyurethane dispersion in any amount necessary to achieve the desired viscosity, but are preferably present at less than 10 wt % and more preferably at less than 5 wt %.

The resulting polyurethane dispersion may have an organic solids content of up to about 60 wt %, an inorganic solids content, e.g., abrasive particles, of up to about 60 wt %, a viscosity of between about 500 and 50,000 cps, a pH of between about 4 and 11 and may include up to about 25 wt % surfactant(s). This polyurethane dispersion will also typically have an average organic particulate size of between about 10 nm and 50 $\mu$m, and preferably less than about 5 $\mu$m to improve its stability.

In order to produce a polyurethane foam from the polyurethane dispersion, the polyurethane dispersion is frothed, typically through the injection of one or more frothing agents, generally including one or more gases such as, for example, air, carbon dioxide, oxygen, nitrogen, argon and helium. The frothing agent(s) is typically introduced into the polyurethane dispersion by injecting the frothing agent, under pressure, into the polyurethane dispersion. A substantially homogeneous froth is then generated by applying mechanical shear forces to the polyurethane dispersion using a mechanical frother. In order to improve the homogeneity of the frothed composition, it is preferred that all components of the polyurethane dispersion, with the exception of the frothing agent, be mixed in a manner that does not incorporate excess quantities of gas into the dispersion prior to the frothing process. The mechanical frothing may be achieved with a variety of equipment, including frothers available from manufacturers including OAKES, COWIE & RIDING and FIRESTONE.

Once the polyurethane dispersion has been frothed, a layer of the frothed composition may be applied to a suitable substrate, such as a polycarbonate sheet or other polymeric material, using application equipment such as a doctor knife or roll, air knife, or doctor blade to apply and gauge the layer. See, for example, U.S. Pat. Nos. 5,460,873 and 5,948,500, the contents of which are hereby incorporated, in their entirety, by reference. The backing material or substrate may also be heated to a temperature between about 25 to 50° C. prior to the application of the frothed polyurethane dispersion.

After the frothed polyurethane dispersion is applied to the substrate, the froth is treated to remove substantially all of the water remaining in the froth and cure the polyurethane materials to form a resilient polyurethane foam having an open cell structure containing fine abrasive particles dispersed generally uniformly throughout the cell walls. The water is preferably removed at least partially by heating the froth and may use one or more energy sources such as an infrared oven, a conventional oven, microwave or heating plates capable of achieving temperatures of from about 50 to 200° C. The froth may also be cured by gradually increasing the temperature in a step-wise or continuous ramping manner. For example, curing a layer of the froth may comprise heating in three steps of approximately 30 minutes each at temperatures of about 70, 125 and 150° C. respectively.

The frothed polyurethane dispersion may be applied to the substrate to achieve a range of layer thicknesses and weights, ranging from about 1 kg/m$^2$ to about 14.4 kg/m$^2$ (about 3.3 oz/ft$^2$ to about 47.2 oz/ft$^2$) dry weight, depending on the characteristics of the substrate, the desired coating weight and the desired thickness. For example, for foams having a thickness between about 3 and 6 mm, the preferred coating weight is from about 2.1 kg/m$^2$ to about 5.7 kg/m$^2$ (about 6.9 oz/ft$^2$ to about 18.7 oz/ft$^2$) dry weight. For foams having a thickness of about 12 mm, the preferred coating weight is from about 9 kg/m$^2$ to about 11.4 kg/m$^2$ (about 29.5 oz/ft$^2$ to about 37.4 oz/ft$^2$) dry weight.

Other types of aqueous polymer dispersions may be used in combination with the polyurethane dispersions described above including styrene-butadiene dispersions; styrene-butadiene-vinylidene chloride dispersions; styrene-alkyl acrylate dispersions; ethylene vinyl acetate dispersions; polychloropropylene latexes; polyethylene copolymer latexes; ethylene styrene copolymer latexes; polyvinyl chloride latexes; or acrylic dispersions, like compounds, and mixtures thereof. Other components useful in preparing suitable aqueous polymer dispersions include polyols having acrylic groups or amine groups, acrylate prepolymers, expoxies, acrylic dispersions, acrylate dispersions and hybrid prepolymers.

The polyurethane foams produced by curing the frothed polyurethane dispersions described above are typically resilient open cell foams, i.e., foams that exhibit a resiliency of at least 5% when tested according to ASTM D3574. The polyurethane foams preferably exhibit a resiliency of from about 5 to 80%, more preferably from about 10 to 60%, and most preferably from about 15 to 50%, and a foam density between about 0.35 and 1.2 g/cm$^3$, preferably between about 0.7 and 1.0 g/cm$^3$, and most preferably between about 0.75 and 0.95 g/cm$^3$.

Figure 3A:
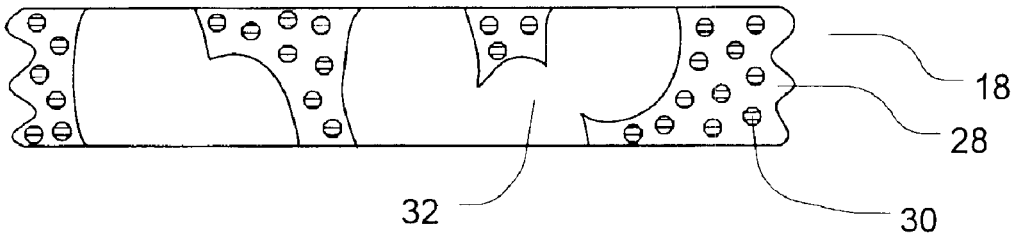
FIG. 3A is a cross-sectional view generally corresponding to a fixed abrasive composition according to an exemplary embodiment of the invention.

As illustrated in FIG. 3A, the fixed abrasive material 19 comprises a polymeric material 28 containing a substantially uniform distribution of abrasive particles 30. The polymeric material has an open cell structure in which small adjacent cells 32 are randomly connected to one another to provide paths for fluid flow from the surface of the fixed abrasive material into and through the bulk of the fixed abrasive material.

Figure 3B:
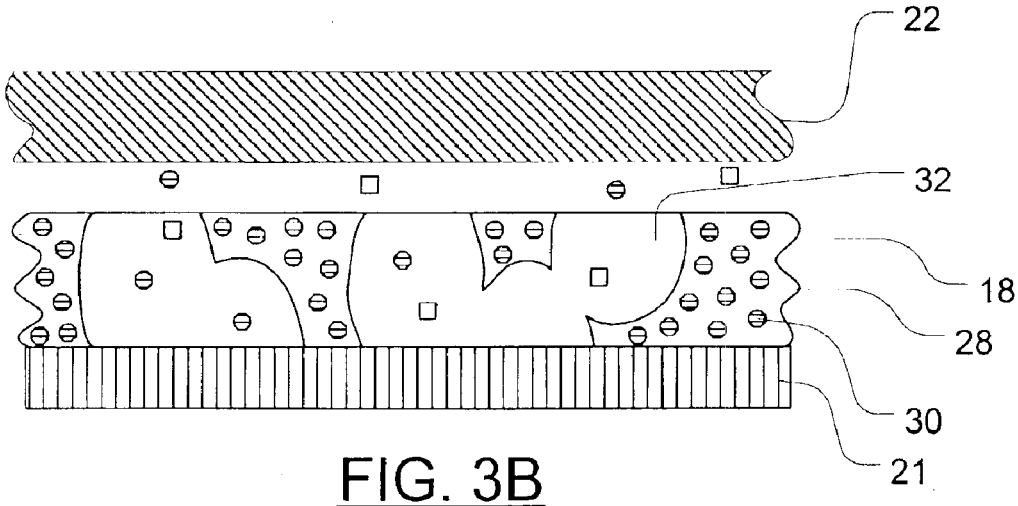
FIG. 3B is a cross-sectional view generally corresponding to a portion of a planarizing pad according to an exemplary embodiment of the invention without conditioning of the pad surface and FIG. 3C is a cross-sectional view generally corresponding to a portion of a planarizing pad according to an exemplary embodiment of the invention with conditioning of the pad surface.
Figure 3C:
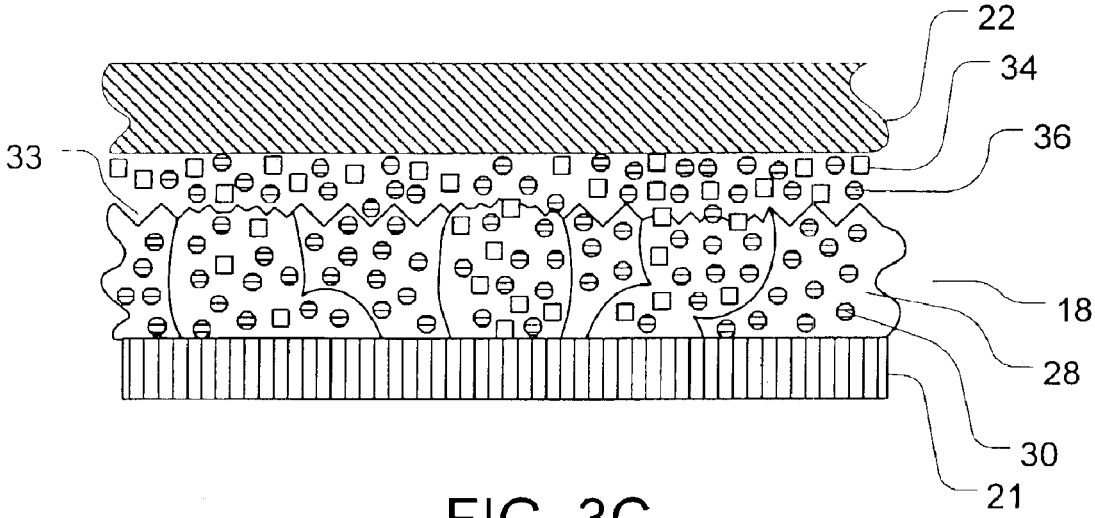

As illustrated in FIG. 3B, in a preferred embodiment, the fixed abrasive material 19 is provided as a substantially uniform layer on a substrate material 21 to form a fixed abrasive planarizing pad 18. In a preferred method, the material is conditioned to form nano-asperities 33 on the exposed major surface of the fixed abrasive material 19. The open cell construction of the fixed abrasive material 19 allows liquid and fine particles to flow into and through the fixed abrasive material and through the substrate material 21. The substrate material 21 can have a multi-layer and/or composite structure. Both the backing or substrate material 21 and the layer of fixed abrasive material 19 can be modified to include various channels or openings (not shown) to provide for process or equipment specific attachment, liquid flow and/or visual or physical access. As will be appreciated, FIGS. 3A–C are intended only to illustrate a simplified embodiment of the fixed abrasive material and a planarizing pad structure utilizing the fixed abrasive material according to the present invention for purposes of discussion and are, consequently, not drawn to scale and should not, therefore, be considered to limit the invention.

Figure 4A:
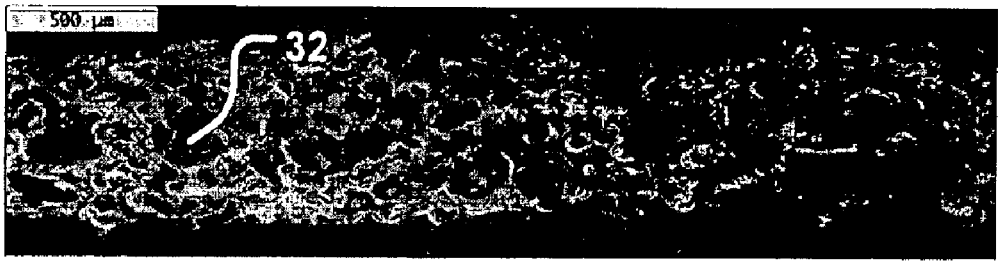
FIGS. 4A–B are SEM microphotographs of a fixed abrasive material manufactured according to an exemplary embodiment of the invention.
Figure 4B:
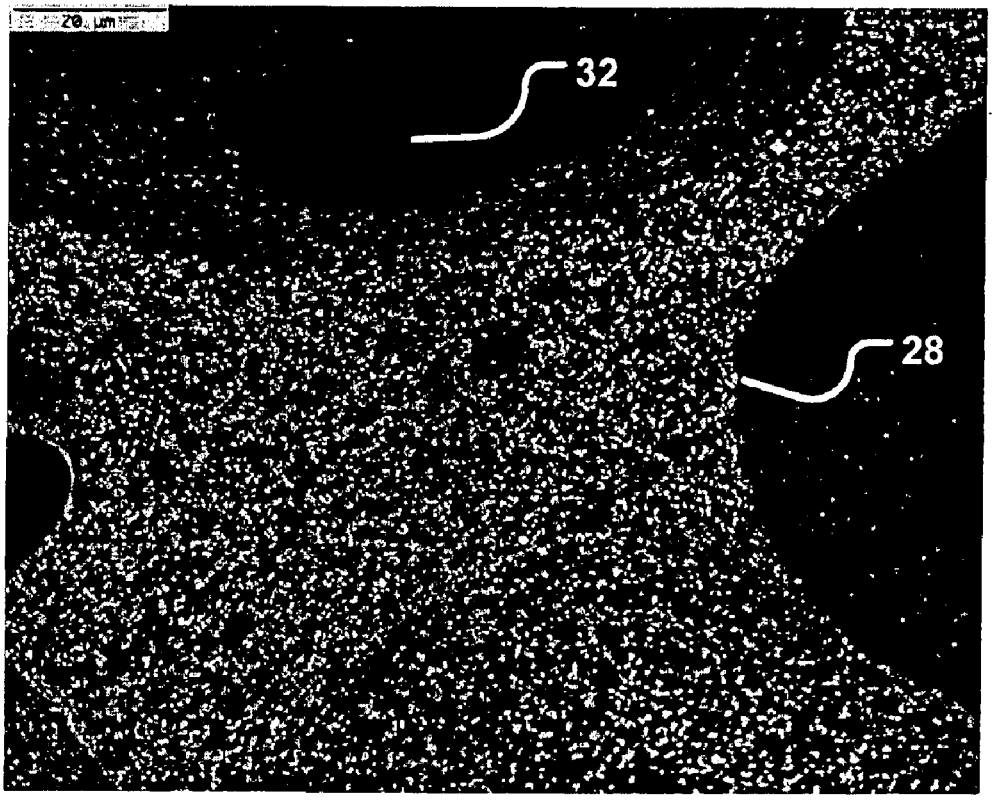

A fixed abrasive material manufactured according to the present invention was examined under a SEM to produce the micrographs provided as FIGS. 4A and 4B. FIG. 4A shows the planarizing pad under a relatively low magnification to illustrate the highly open structure of the fixed abrasive material manufactured according to the present invention. FIG. 4B shows a portion of the fixed abrasive material under much higher magnification to reveal details of the cell structure and illustrate the uniform distribution of the abrasive particles, i.e., the bright specks, throughout the polymeric composition forming the cell walls.

The polymer matrix may have a density from about 0.5 to about 1.5 g/cm$^3$, preferably from about 0.7 to about 1.4 g/cm$^3$, more preferably from 0.9 and about 1.3 g/cm$^3$, and most preferably between about 1.1 and 1.25 g/cm$^3$. The polymer matrix may have a Shore A hardness of from about 30 and about 90, preferably from about 70 to about 85, and more preferably from about 75 and about 85. The polymer matrix may have a percent rebound at 5 psi of from about 30 to about 90, preferably from about 50 to about 80, and more preferably from about 50 and about 75. The polymer matrix may have a percent compressibility at 5 psi of from about 1 to about 10%, preferably from about 2 to about 6%, more preferably from about 2 to about 4%. The polymer matrix may have a porosity of between about 5 and 60%, preferably between about 10 and 50%, and more preferably, between about 20 and 40%. The polymer matrix may have an average cell size between about 5 and 500 $\mu$m, preferably between about 30 and 300 $\mu$m, and more preferably between about 30 and 200 $\mu$m.

Planarization pads manufactured from a fixed abrasive material according to the present invention may be used to removed one or more materials from a major surface of a semiconductor substrate in a process in which:

a carrier liquid to the polishing surface of a polishing pad, the polishing pad having an open cell structure of a thermoset polymer matrix defining a plurality of interconnected cells and abrasive particles distributed throughout the polymer matrix;

causing relative motion between the substrate and the polishing surface of the polishing pad in a plane generally parallel to the major surface of the substrate while applying a force tending to bring the major surface and the polishing surface into contact;

conditioning the polishing surface, thereby releasing abrasive particles from the polymer matrix to form free abrasive particles; and polishing the major surface of the substrate with the free abrasive particles to remove a portion of the material from the major surface of the substrate.

The steps of this method may be performed sequentially, or in a continuous process wherein one or more of the steps are performed substantially concurrently. In a preferred process, the steps of applying a carrier liquid, conditioning, and causing relative motion are performed concurrently. The method may be performed with any of a variety of devices, including devices among conventionally used for CMP processes in the art.

The methods of this invention comprise the application of a carrier liquid to the polishing surface of the polishing pad. A carrier liquid is any liquid which is capable of wetting and facilitating the conditioning of the polishing pad. Carrier liquids may be solutions or emulsions, and are preferably aqueous. Carrier liquids or carrier emulsions may include, for example, wetting agents, suspension agents, pH buffering agents, oxidizers, chelating agents, oxidizing agents and/or abrasive particles. A preferred carrier liquid for oxide removal comprises deionized (DI) water and a suitable combination of acid or base materials so as to adjust the pH of the liquid to a pH of from about 4 to about 10, preferably from about 5 to about 8 and one or more other components. Conversely, a preferred carrier liquid for the removal of metal such as copper (Cu) may comprise an oxidizer solution, for example about 5 wt % hydrogen peroxide, in combination with a chelating agent and one or more surfactants. Suitable chelating agents include aminocarboxylates such as ethylenediaminetetraacetic acid (EDTA), hydroxyethylethylenediaminetriacetic acid (HEDTA), nitrilotriacetic acid (NTA), diethylenetriaminepentaacetic acid (DPTA), ethanoldiglycinate and mixtures thereof.

The application of a carrier liquid to the polishing surface of the polishing pad is preferably conducted substantially concurrently with the conditioning of the polishing surface. The carrier liquid may be applied using any suitable means that will supply a sufficient quantity and distribution of the carrier liquid across the polishing surface of the pad. Such means include methods and apparatus similar to those known and used in the art for applying conditioning or planarization slurries.

The polishing surface of a conventional polishing pad is preferably conditioned during a "break-in" step and qualified using dummy wafers before the polishing pad may be released for production of semiconductor devices. The process of breaking-in a conventional fixed abrasive polishing pad tends to increase the friction between the polishing pad and substrate to be polished, increase the surface roughness of the polishing pad, and remove any film or deposit formed on the polishing surface. Conditioning is also typically used periodically to regenerate the polishing surface after polishing a number of semiconductor wafers, when the material removal rate drops below some target value or when some other monitored parameter, e.g., surface temperature drifts out of a desired range. Both break-in and in-process conditioning of conventional polishing pads are intended to produce a polishing surface that provides a stable and sufficiently high material removal rate and uniform polishing.

Although a polishing pad faced with abrasive material fixed in a polymer matrix as detailed above may be capable of removing material from the surface of a substrate at a low rate during a CMP process, the material removal rate may be improved in a preferred embodiment by creating free abrasive particles through the in-situ conditioning of the polishing surface. In a preferred embodiment, the open cell structure of the fixed abrasive material reduces or eliminates the need for conventional "break-in" conditioning to prepare the polishing pad prior to polishing. Preferably, the free abrasive particles comprise a mixture of abrasive particles, composite abrasive/polymer particles and polymer particles that have separated from the polymer matrix by the conditioning process. In a preferred method, the free abrasive particles combine with a carrier liquid to form a planarization slurry that cooperates with the planarization surface to remove the targeted material layer from the surface of a semiconductor substrate.

Figure 6A:
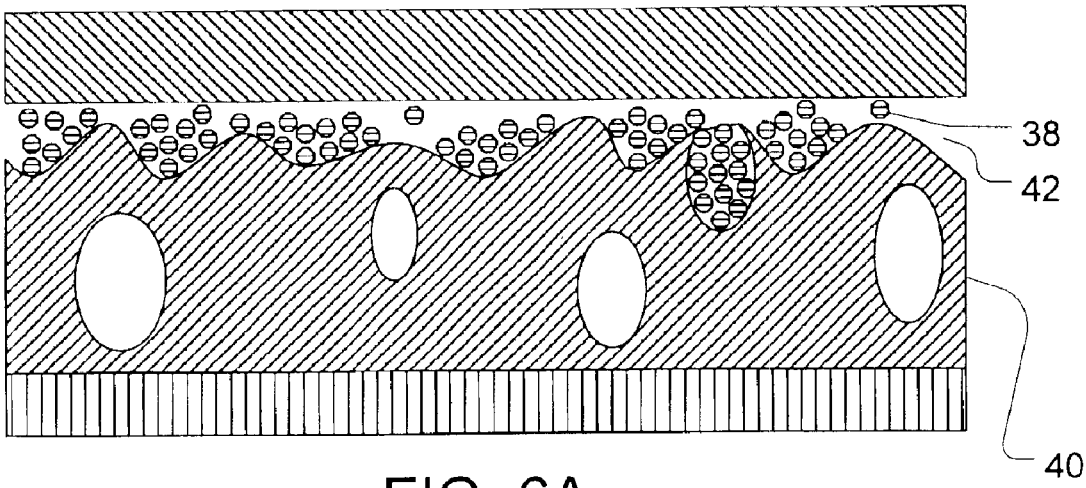
FIGS. 6A–B are cross sectional views comparing a conventional CMP process and a CMP process according to an exemplary embodiment of the invention.
Figure 6B:
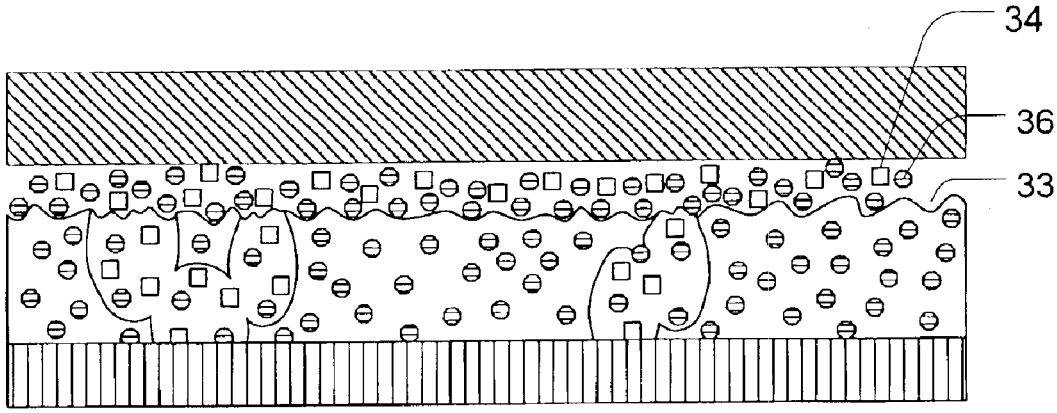
Figure 7A:
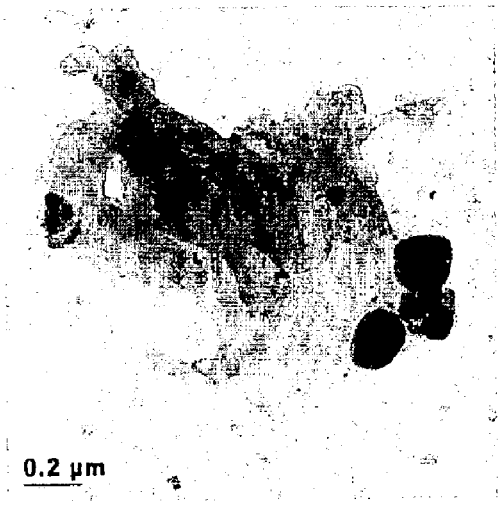
FIGS. 7A–D are SEM micrographs reflecting the range of particle composition produced by the conditioning of fixed abrasive pads according to an exemplary embodiment of the invention.
Figure 7B:
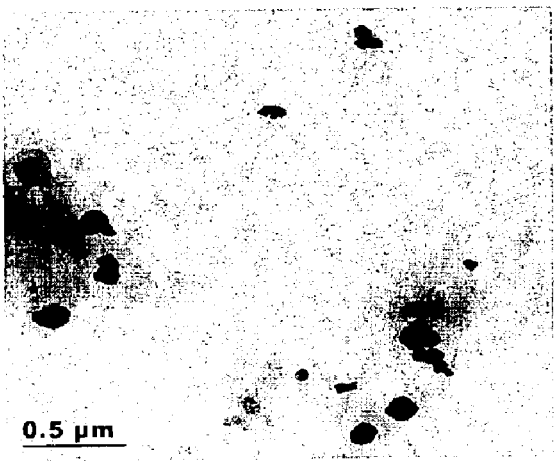
Figure 7C:
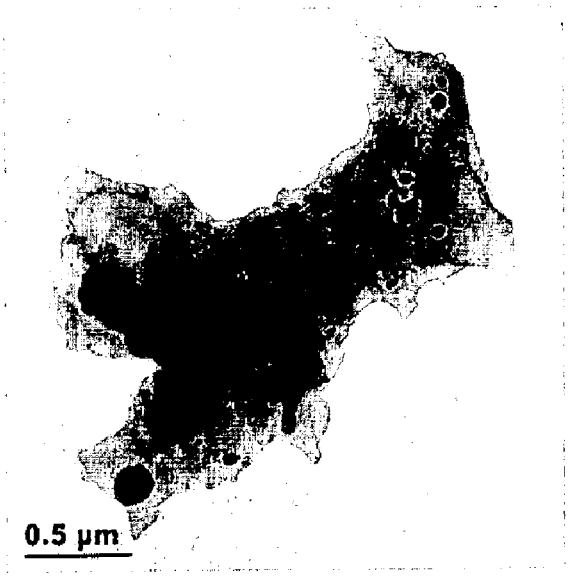
Figure 7D:
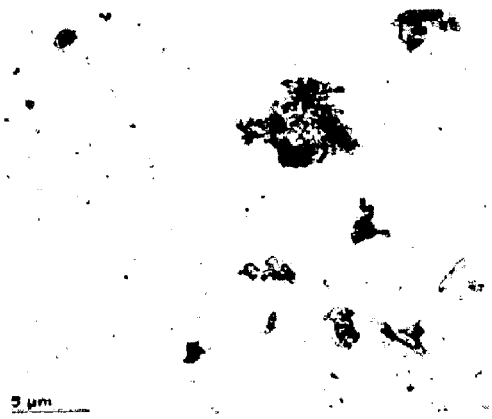

As illustrated in FIG. 6A, conventional planarizing pads, such as those having a closed cell foam layer 40, were formed and/or conditioned to have relatively large asperities 42, i.e., on a micron scale, in which abrasive particles 38 could accumulate, increasing the chance of scratching or otherwise damaging the surface of the substrate being planarized. As illustrated in FIG. 6B, however, it is believed that the composition of a planarizing pad according to the present invention provides for the release of both abrasive particles 36 and polymer particles 34 and the creation of much smaller nano-asperities 33 that reduce the possibility of abrasive accumulations that would tend to damage the substrate surface, resulting in reduced defectivity. Also as illustrated in FIG. 6B, it is believed that the combination of the abrasive particles and the polymer particles cooperates to improve the degree of planarity that can be achieved with fixed abrasive pads and planarization methods according to the present invention.

Also, preferably, the majority of the free abrasive particles will range in size between that of the abrasive particles, typically about 0.5 to 1.0 $\mu$m or less, to that of the composite abrasive/polymer particles, typically about 30 to 50 $\mu$m., that are released by the conditioning of the planarization surface. As referred to herein, the composite abrasive/polymer particles refer to small pieces the polymer matrix that have abrasive particles attached or embedded.

As reflected in the SEM micrographs in FIGS. 7A–D, the particles released from fixed abrasive pads according to exemplary embodiments of the invention may include a mixture of abrasive particles, polymer particles and composite particles including abrasive particles still within a polymer matrix. This mixture of particles acts to reduce the defectivity of the resulting polished surface.

The conditioning step of this invention preferably comprises:

placing a conditioning surface of a conditioning element adjacent the polishing surface; and inducing relative motion between the conditioning element and the polishing pad in a plane generally parallel to the polishing surface while applying a force tending to bring the conditioning surface and the polishing surface into contact. Preferably from about 0.01 to about 0.5 μm of the polymer matrix is removed from the polishing surface during the conditioning step for each substrate that is polished.

The material removed from the polishing surface of the polishing pad by the conditioning will combine with the carrier liquid to form an in-situ slurry comprising between about 0.01 and 10 wt % solids, preferably between about 0.1 and 5 wt % solids, and more preferably, between about 0.1 and 2 wt % solids. The average polymer particle size within the in-situ slurry may be between about 1 μm and 25 μm and may typically be between about 0.1 μm and 10 μm, preferably between about 0.5 μm and 5 μm, and more preferably between about 0.5 μm and 2 μm. By forming the slurry in-situ, the exemplary embodiments of the invention avoid the difficulties associated with maintaining a separate slurry for use in a CMP process such as the need for agitation and the risk of agglomeration of the abrasive particles.

Conditioning elements typically comprise a device configured for attachment to conditioning equipment (e.g., a mechanical arm) with a substantially planar or cylindrical conditioning surface opposite the attachment point. The actual conditioning requires relative movement between the conditioning surface and the polishing surface as the surfaces are urged together by a compressive force or load. In many instances, both the conditioning surface and the polishing surface are rotated simultaneously with the conditioning surface also being moved across the polishing surface in a linear or arcuate fashion.

Conditioning elements are usually considerably smaller in diameter than the polishing pad they used to condition and may be generally configured as disks, rings or cylinders. The conditioning elements may include solid and or patterned surfaces and may include bristles or filaments for "brush" configurations. In order to condition substantially all of the polishing surface, the conditioning equipment may pass the conditioning element from the center of the polishing surface to the edge and back to the center (bi-directional conditioning) or may pass the conditioning element only from the center to the edge of the polishing pad (unidirectional conditioning).

If more than one pass of the conditioning element is necessary to achieve the desired polishing surface in a uni-directional system, the conditioning element is raised to avoid contact with the polishing surface, centered, lowered and again swept to the edge of the pad. Such unidirectional conditioning may also help sweep debris and other material off the polishing surface as it the conditioning elements moves to and perhaps past the edge of the polishing surface.

Conditioning elements may incorporate a wide range of shapes, particle type or types, particle size, surface topography, particle pattern, or modifications made to the element surface or particles. For example, the conditioning surface of the conditioning element may include grooves in a circular, linear, grid or combination pattern. Similarly, the conditioning particles may be arrayed on the conditioning surface circular, linear, grid, combination or random patterns and may incorporate more than one type or size of conditioning particle.

The conditioning surface of a conditioning element typically includes abrasive particles of sufficient hardness and size to abrade the polishing surface. The conditioning particles may include one or more of polymer, diamond, silicon carbide, titanium nitride, titanium carbide, alumina, alumina alloys, or coated alumina particles, with diamond particles being widely used. Conditioning particles may be provided on a conditioning surface using a variety of techniques including, for example, chemical vapor deposition (CVD), formed as a part of a substantially uniform conditioning material or may be embedded in another material. The manner in which the conditioning particles are provided on the conditioning surface need only be sufficient to enable the conditioning surface to have the desired effect on the surface being conditioned.

Many conditioning elements are provided as disks or rings and may be formed with diameters ranging from about 1 to about 16 inches (2.5 to 40.6 cm) and more commonly are provided in diameters between about 2 and 4 inches (5.1 and 10.2 cm). Diamond conditioner elements, specifically conditioner disks may be obtained from Dimonex, Inc. (Allentown, Pa.), 3M (Minneapolis, Minn.) and others. In those instances in which the conditioning elements are provided as rings, the width of the ring portion of the conditioning element may range from about 0.5 to 2 inches (1.3 to 5.1 cm).

The size, density and distribution of the conditioning particles provided on the conditioning surface will affect how much material the conditioning element removes during each pass of the surface being conditioned. As a result, conditioning particles generally exhibit an average diameter of from about 1 to 50 μm and more typically exhibit a diameter of from about 25 to 45 μm. Similarly, the number of conditioning particles provided on the conditioning surface (i.e., the particle density) tends to be between about 5 to 100 particles/mm$^2$ and more typically tends to be between about 40 to 60 particles/mm$^2$.

As one of ordinary skill in the art will appreciate, conditioning requires that the conditioning surface be brought into contact with the polishing surface while some force or down pressure is applied to maintain the necessary degree of contact between the surfaces. The amount of force applied will affect the conditioning process and is generally maintained within a range during the conditioning process. The down force applied to the conditioning element may be between about 0.5 or 6 pounds force/in$^2$ (about 3.45 to 41.4 kPa) and, more typically, may be between about 1 and 4 pounds force/in$^2$ (about 6.9 to 27.6 kPa).

Another variable in both break-in and in-process conditioning processes is the number of passes made by the conditioning surface across the polishing surface. As will be appreciated, if all other conditions remain the same, increasing the number of passes will increase the thickness of the material removed from the polishing surface. The goal in most conventional conditioning processes is to reduce the number of passes required to achieve the desired degree of conditioning of the polishing surface to increase the life of the polishing surface and increase the available production time.

As discussed above, various factors affect the rate at which the polishing surface will be removed by the action of the conditioning surface during a conditioning process. Conventional break-in conditioning may remove between about 0.2 to 3.0 μm the polishing surface and more typically may remove between about 1.5 to 3.0 μm. In process conditioning may remove a similar quantity of the polishing surface.

In a preferred embodiment, unlike the conventional and prior art fixed abrasive polishing pads, a polishing pad according to the present invention does not include any macroscopic three-dimensional structures or alternating regions of distinctly different materials on the polishing surface. As illustrated in FIG. 3B, absent conditioning, such a polishing pad faced with the fixed abrasive material does not tend to release or to expose a sufficient quantity of abrasive particles and thus exhibits a relatively low material removal rate of a material layer from the surface of a semiconductor substrate. As illustrated in FIG. 3C, however, conditioning the polishing surface of a polishing pad faced with fixed abrasive material according to the present invention releases a quantity of the fixed abrasive particles and polymer matrix. These released particles are then free to combine with the carrier liquid to form an in-situ planarizing slurry capable of removing material from a semiconductor substrate at an increased rate.

In one embodiment, the method of this invention further comprises the step of terminating or modifying the rate of polishing. Preferably, the termination or modification of the rate of polishing comprises one or more actions selected from a group consisting of:

terminating or modifying the relative motion of the substrate and the polishing pad;

removing the substrate from contact with the polishing pad;

terminating or modifying the conditioning of the polishing surface;

modifying the pH of the carrier liquid; and reducing the oxidizer concentration in the carrier liquid.

Preferably the pH of the carrier liquid is modified by adding a suitable acid or base to the liquid during the step of applying the conditioning liquid to the pad. In a preferred method, the polishing rate is decreased by increasing the pH of the carrier liquid, thereby reducing a rate at which oxide is removed from the major surface by at least about 50%. A preferred method for removing oxide from a major surface of a semiconductor comprises increasing the pH of the carrier liquid to pH 10 or more, preferably reducing the rate at which oxide is removed from the major surface is by at least about 75%.

Preferably the oxidizer concentration of the carrier liquid is reduced by slowing or terminating the addition of the oxidizer, such as hydrogen peroxide, to the carrier liquid, by switching to a less oxidizing carrier liquid, such as DI water, or by diluting the carrier liquid through the addition of excess DI water. In a preferred method, the polishing rate is decreased by reducing the oxidizer concentration of the carrier liquid, thereby reducing a rate at which metal, such as copper, is removed from the major surface of the semiconductor substrate by at least about 50%, and more preferably, by at least about 75%.

Figure 5A:
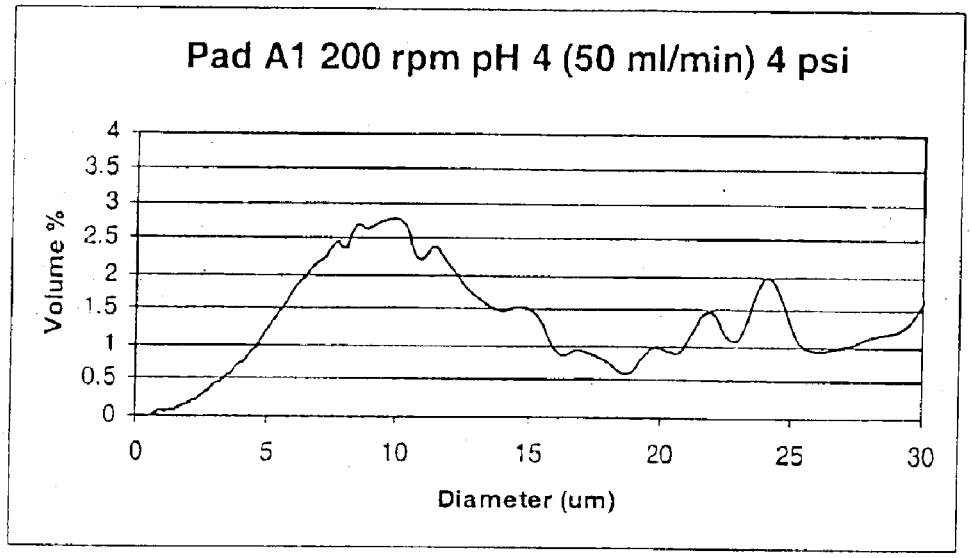
FIGS. 5A–C are graphs reflecting the particle size distribution of the effluent from the conditioning of a fixed abrasive pad according to an exemplary embodiment of the invention wetted with carrier liquids having varying pH.
Figure 5B:
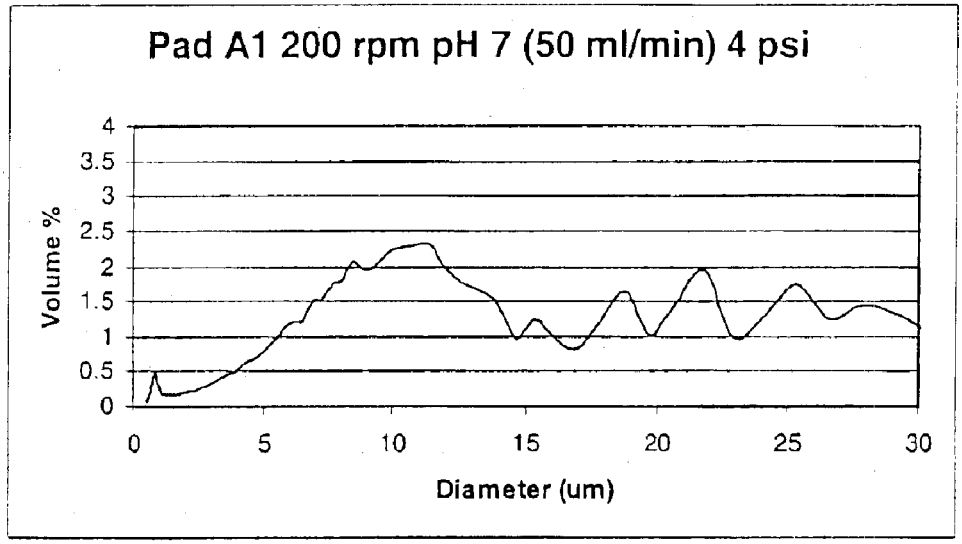
Figure 5C:
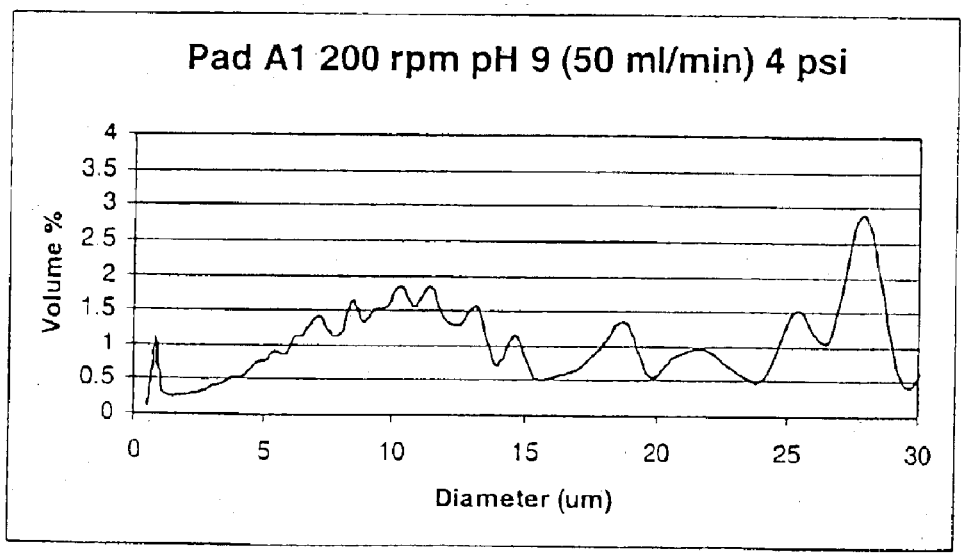

As reflected in FIGS. 5A–C, the pH of the carrier liquid exhibits a significant effect on the size distribution of the material being removed from a fixed abrasive pad according to an exemplary embodiment (Example A1) of the invention with conditioning at 4 psi with 50 ml/min of the carrier liquid being applied. As reflected in the graphs, reducing the pH to 4 effectively terminated the release of the abrasive ceria particles (indicated by the lack of a peak near 1 $\mu$m) while increasing the pH to 9 increased both the number of free ceria abrasive particles and increased the average size of the particles present in the in-situ slurry.

A preferred method for the CMP of an oxide layer according to this invention comprises:

placing the oxide adjacent a polishing surface of a polishing pad, the polishing pad having an open cell structure of a thermoset polymer matrix defining a plurality of interconnected cells and abrasive particles distributed throughout the polymer matrix;

applying a carrier liquid to the polishing surface, the carrier liquid having a pH of between about 5 and about 8;

causing relative motion between the substrate and the polishing pad in a plane generally parallel to the oxide layer while applying a force tending to bring the oxide layer and the polishing surface into contact;

conditioning the polishing surface, thereby releasing abrasive particles from the polymer matrix to form free abrasive particles;

combining the carrier liquid and the free abrasive particles to form a planarizing slurry; and polishing the oxide with the planarizing slurry to remove a portion of the oxide from the substrate.

The methods of this invention also afford a method of selectively removing oxide and nitride from the surface of the substrate. Such methods comprise, removing nitride from the major surface of the semiconductor at a first rate wherein the oxide is removed from the major surface at a second rate, wherein the second rate is at least 4 times, preferably at least 6 times, the first rate.

A preferred method for the CMP of a metal layer according to this invention comprises:

applying a carrier liquid to the polishing surface of a polishing pad, the polishing pad having an open cell structure of a thermoset polymer matrix defining a plurality of interconnected cells and abrasive particles distributed throughout the polymer matrix, and the carrier liquid having an oxidizer concentration;

causing relative motion between the substrate and the polishing pad in a plane generally parallel to the oxide layer while applying a force tending to bring the metal layer and the polishing surface into contact;

conditioning the polishing surface, thereby releasing free abrasive particles from the polymer matrix;

combining the carrier liquid and the free abrasive particles to form a planarizing slurry; and polishing the metal with the planarizing slurry to remove a portion of the metal from the substrate.

The methods of this invention also afford a method of selectively removing a metal layer and an underlying barrier layer from the surface of the substrate in which the barrier layer is removed from the major surface of the semiconductor substrate at a first rate and the metal layer is removed from the major surface at a second rate wherein the second rate is at least 4 times the first rate.

The following exemplary examples are provided to illustrate the present invention. The examples are not intended to limit the scope of the present invention and should not be so interpreted. All percentages are by weight unless otherwise noted.

EXAMPLE A1

An exemplary polyurethane, composition A1, was prepared by combining:

80 parts WITCOBOND A-100 (WITCO Corp.);

20 parts WITCOBOND W-240 (WITCO Corp.);

15 parts surfactant (consisting of 9 parts STANFAX 320, 3 parts STANFAX 590, and 3 parts STANFAX 318) (Para-Chem Southern Inc.);

8.5 parts ACUSOL 810A (as a viscosity modifier/thickener) (Rohm & Haas); and 100 parts 500 nm ceria particles to form an aqueous dispersion (all parts reflecting dry weight). The polyurethane dispersion was then allowed to stand for approximately one hour to stabilize the viscosity at about 9500 cps. The polyurethane dispersion was then frothed using an OAKES frother to produce a froth having a density of approximately 1040 grams per liter and applied to a polycarbonate substrate to a thickness of about 1.5 mm. The froth was then cured for 30 minutes at 70° C., 30 minutes at 125° C., and 30 minutes at 150° C. to form a foam product comprising a fixed abrasive material having a foam density between about 0.75 and 0.95 g/cm$^3$.

Although the Examples include viscosities between about 8000 and 10,000 cps, depending on the application, the viscosity of the frothed polyurethane dispersions could range between about 5000 and 15,000 or perhaps higher while still producing fixed abrasive materials incorporating the advantages of the present invention. Similarly, depending on the application, the density of the frothed polyurethane dispersions could be adjusted to provide either more or less dense froths that could range from about 500 grams per liter to about 1500 or more grams per liter.

EXAMPLE A2

Another exemplary polyurethane composition, composition A2, was prepared by combining:

60 parts WITCOBOND A-100;

40 parts WITCOBOND W-240;

15 parts surfactant (consisting of 9 parts STANFAX 320, 3 parts STANFAX 590, and 3 parts STANFAX 318);

8.5 parts ACUSOL 810A (as a viscosity modifier/thickener); and 70 parts 500 nm ceria particles to form an aqueous dispersion. The polyurethane dispersion was then allowed to stand for approximately one hour to stabilize the viscosity at about 10,000 cps. The polyurethane dispersion was then frothed using an OAKES frother to produce a froth having a density of approximately 970 grams per liter and applied to a polycarbonate substrate to a thickness of about 1.5 mm. The froth was then cured for 30 minutes at 70° C., 30 minutes at 125° C., and 30 minutes at 150° C. to form a foam product comprising a fixed abrasive material having a foam density between about 0.75 and 0.95 g/cm$^3$.

EXAMPLE A3

Another exemplary polyurethane composition, composition A3, was prepared by combining:

20 parts WITCOBOND A-100;

80 parts WITCOBOND W-240;

15 parts surfactant (consisting of 9 parts STANFAX 320, 3 parts STANFAX 590, and 3 parts STANFAX 318);

8.5 parts ACUSOL 810A (as a viscosity modifier/thickener); and 70 parts 500 nm ceria particles to form an aqueous dispersion. The polyurethane dispersion was then allowed to stand for approximately one hour to stabilize the viscosity at about 10,000 cps. The polyurethane dispersion was then frothed using an OAKES frother to produce a froth having a density of approximately 970 grams per liter and applied to a polycarbonate substrate to a thickness of about 1.5 mm. The froth was then cured for 30 minutes at 70° C., 30 minutes at 125° C., and 30 minutes at 150° C. to form a foam product comprising a fixed abrasive material having a foam density between about 0.75 and 0.95 g/cm$^3$.

EXAMPLE B1

Another exemplary polyurethane composition, composition B1, was prepared by combining:

40 parts WITCOBOND A-100;

60 parts WITCOBOND W-240;

15 parts surfactant (consisting of 9 parts STANFAX 320, 3 parts STANFAX 590, and 3 parts STANFAX 318);

8.5 parts ACUSOL 810A (as a viscosity modifier/thickener); and 50 parts 500 nm ceria particles to form an aqueous dispersion. The polyurethane dispersion was then allowed to stand for approximately one hour to stabilize the viscosity at about 9660 cps. The polyurethane dispersion was then frothed using an OAKES frother to produce a froth having a density of approximately 997 grams per liter and applied to a polycarbonate substrate to a thickness of about 1.5 mm. The froth was then cured for 30 minutes at 70° C., 30 minutes at 125° C., and 30 minutes at 150° C. to form a foam product comprising a fixed abrasive material having a foam density between about 0.75 and 0.95 g/cm$^3$.

EXAMPLE B2

Another exemplary polyurethane composition, composition B2, was prepared by combining:

A preferred prepolymer composition may be prepared by combining:

80 parts WITCOBOND A-100;

20 parts WITCOBOND W-240;

15 parts surfactant (consisting of 9 parts STANFAX 320, 3 parts STANFAX 590, and 3 parts STANFAX 318);

8.5 parts ACUSOL 810A (as a viscosity modifier/thickener); and 100 parts 1 $\mu$m ceria particles to form an aqueous dispersion. The polyurethane dispersion was then allowed to stand for approximately one hour to stabilize the viscosity at about 8270 cps. The polyurethane dispersion was then frothed using an OAKES frother to produce a froth having a density of approximately 943 grams per liter and applied to a polycarbonate substrate to a thickness of about 1.5 mm. The froth was then cured for 30 minutes at 70° C., 30 minutes at 125° C., and 30 minutes at 150° C. to form a foam product comprising a fixed abrasive material having a density between about 0.75 and 0.95 g/cm$^3$.

With regard to the specific components identified above WITCOBOND A-100 is an aqueous dispersion of an aliphatic urethane/acrylic alloy, WITCOBOND W-240 is an aqueous dispersion of an aliphatic urethane, ACUSOL 810A is an anionic acrylic copolymer, STANFAX 318 is an anionic surfactant comprising sodium sulfosuccinimate used as a foam stabilizer, STANFAX 320 is an anionic surfactant comprising ammonium stearate used as a foaming agent, and STANFAX 519 is a surfactant comprising a di-(2-ethylhexyl) sulfosuccinate sodium salt used as a wetting/penetrant agent.

The abrasive materials corresponding to Examples A1 and B1 were subjected to additional testing as reflected below in Table 1.

TABLE 1

| Parameter | Example A1 | Example B1 |
|---|---|---|
| Shore A Hardness | 78.2–84.4 | 79.1–88.6 |
| % Compressibility at 5 psi | 2.03–3.63 | 2.00–4.09 |
| % Rebound at 5 psi | 45.0–77.0 | 53.9–76.0 |
| Foam Density (g/cm$^3$) | 0.79 | 0.76 |

Additional characterization tests were conducted using samples of the fixed abrasive compositions produced according to Examples A1, A2, B1 and B2 including a mercury porosimetry analysis. The mercury porosimetry analysis was performed on a Micromeritics Autopore IV 9520. Prior to the analysis, the samples were out-gassed at room temperature under a vacuum to remove the majority of any physiosorbed species from the surface of the materials and then cut into rectangles (approximately 15 mm×25 mm) to help provide a substantially constant area basis and producing samples of approximately 0.43–0.49 g.

The test conditions included a Hg fill pressure of 0.41 psia, a Hg contact angle of 130.0°, a Hg surface tension of 485.0 dyn/cm, a Hg density of 13.53 g/ml, a 5 minute evacuation time, small bore penetrometer (solid type) with a 5-cc bulb, a 30 second equilibration time, 92-point pressure table (75 intrusion+17 extrusion pressure points) with mechanical evacuation to less than 50 $\mu$m Hg. The pressure table used was adapted to provide an even incremental distribution of pressures on a log scale from 0.5 to 60,000 psia.

During the test Hg is forced into smaller and smaller pores as the pressure is increased incrementally from the initial vacuum to a maximum of nearly 60,000 psia. Hg porosimetry data including total intrusion volume, median pore diameter (volume), and bulk density is achieved with a precision of <3% RSD (relative standard deviation) for this instrument.

The initial unadjusted results for the Hg porosimetry data representing pore sizes between 0.003 and 400 $\mu$m diameter (calculated pressure range of 0.5–60,000 psia) are summarized in Table 2.

TABLE 2

| Sample | Median Pore Dia. (Vol.) $\mu$m | Bulk Density g/ml | Apparent (Skeletal) Density g/ml | Porosity, % |
|---|---|---|---|---|
| A1 | 94.5036 | 0.8687 | 1.3765 | 36.8895 |
| A2 | 44.9445 | 0.9774 | 1.3566 | 27.9543 |
| B1 | 94.2876 | 0.8481 | 1.3354 | 36.4905 |
| B2 | 54.9848 | 0.9462 | 1.3312 | 28.9205 |

Hg porosimetry is a bulk analysis of the overall porosity, and interstitial (void) filling (apparent porosity) may be created while the Hg is pushing its way between the pieces or particles of sample at low fill pressures. Typically, this is only a problem with small meshed or powdered materials and doesn't seem to be occurring for these samples.

However, because the samples are polyurethane/polycarbonate materials, it was expected that there would be some apparent intrusion during the Hg porosimetry measurements as a result of sample compression (Hg filling due to compression of the polymer with increasing Hg fill pressures). Because of this, the intraparticle pore volume (actual pore filling resulting from macropores) must be subtracted from the apparent pore volume (apparent pore filling resulting from sample compression) to determine the actual pore volume. Performing this adjustment produced the data summarized in Table 3 representing pore sizes between 5 and 400 $\mu$m diameter (for a calculated pressure range of 0.5–35 psia).

TABLE 3

| Sample | Median Pore Dia. (Vol.), $\mu$m | Bulk Density g/ml | Apparent (Skeletal) Density, g/ml | Porosity, % |
|---|---|---|---|---|
| A1 | 98.4307 | 0.8687 | 1.2925 | 32.7868 |
| A2 | 49.5243 | 0.9774 | 1.2738 | 23.2691 |
| B1 | 102.0095 | 0.8481 | 1.2562 | 32.4893 |
| B2 | 58.1107 | 0.9462 | 1.2521 | 24.4332 |

Figure 4C:
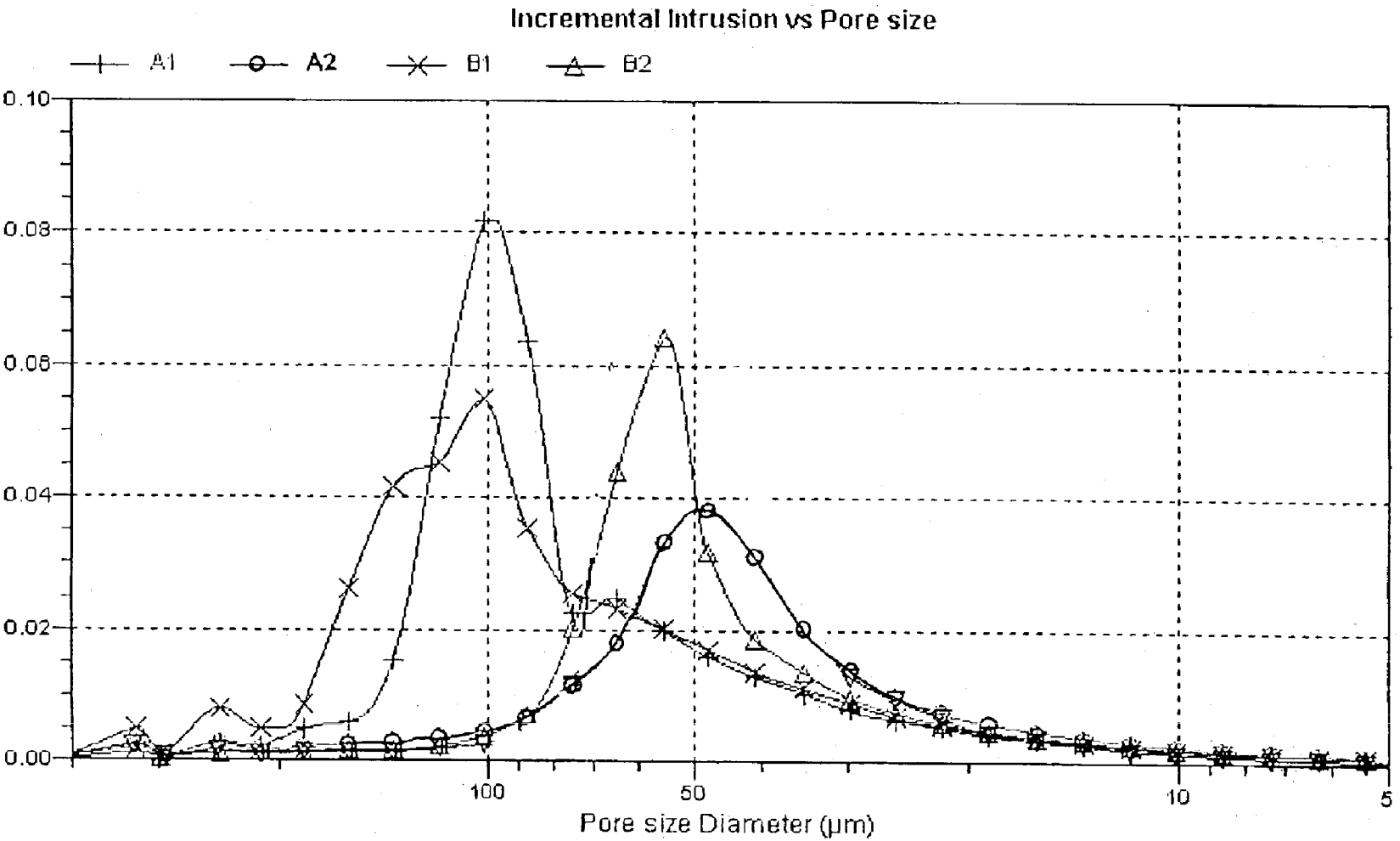
FIG. 4C is a graph illustrating the measured pore size distribution for exemplary embodiments of the invention.

The accuracy of the adjusted data was confirmed by comparing the sample total pore area (determined using Hg porosimetry) with its measured B.E.T. (Bruner, Emmett, and Teller) surface area (determined by krypton adsorption) of <0.05 m$^2$/g. The porosity data for the tested samples is reflected in the graph illustrated in FIG. 4C.

FIGS. 5A–C are graphs reflecting the particle size distribution of the effluent from the conditioning of a fixed abrasive pad according to an exemplary composition A1 of the invention wetted with carrier liquids having varying pH. A comparison of the graphs of FIGS. 5A and 5C, with the corresponding shift in pH from 4 to 9 is reflected in an increase in the concentration of the released abrasive (ceria) particles within the in-situ slurry being generated by the conditioning process. FIG. 5B reflects a release of ceria particles using a carrier liquid of pH 7, but at a reduced concentration compared to that achieved at pH 9.

Sample planarizing pads were manufactured using the polyurethane dispersions described above in connection with the exemplary compositions A1 and B2. These two polyurethane dispersions were then frothed using air as the frothing agent to produce a polyurethane froth having a density of about 850–1100 g/liter. A layer of the froth having a thickness of between about 1 and about 2 mm was then applied to a substrate of polycarbonate sheeting. The froth layer was then cured at 70° C. for 30 minutes, 125° C. for 30 minutes, and 150° C. for 30 minutes to produce a composite structure faced with a fixed abrasive polyurethane foam having an open cell structure, including an open surface structure, and a density of between about 0.7 and 0.9 g/cm$^3$.

Test planarization pads of approximately 4"×4" (about 10 cm×10 cm), of the composite structures having fixed abrasive polyurethane foam layers formed from polyurethane dispersion A1 were then cut from the cured fixed abrasive polymer compositions. These test planarization pads where then loaded onto a CMP device and used to polish a series of 2 inch (5 cm) wafers having uniform surface layers of Cu, $SiO_2$, SiN or SiC to evaluate the coefficient of friction (COF) of the pad on these various materials.

The CMP device utilized in this exemplary example provided for wafer and platen rotation rates from 60–200 rpm at loads of 2–4 psi. The sample pads were mounted on a SUBA-IV (Rodel) foamed polymer layer attached to the platen. Continuous in-situ diamond conditioning with a 3M diamond disk 0190-77499 3M 49860-6 100203 conditioning disk rotating at 60 rpm with a 2 psi load applied was used to release abrasive particles and polymer particles from the polishing surface of the sample planarization pads for the duration of this evaluation. The load for the polishing procedure was 4 psi at 120 rpm. No break-in conditioning was applied to the sample planarization pads before the start of this evaluation.

Coefficient of Friction Evaluation

Figure 8:
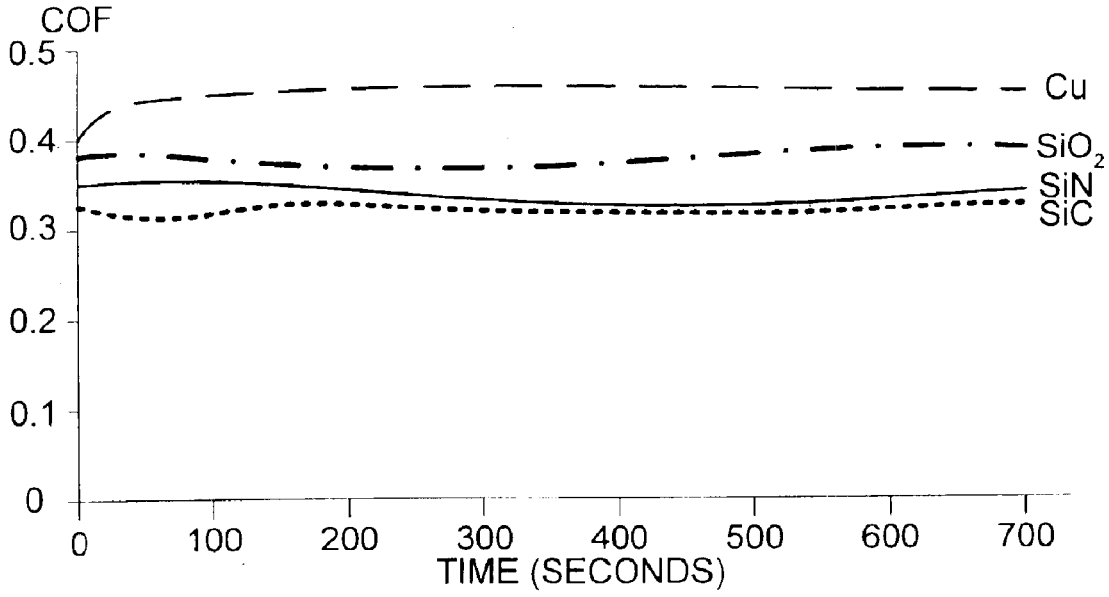
FIG. 8 is a graph illustrating a coefficient of friction evaluation for various materials using a planarization pad according to an exemplary embodiment of the invention.

The CMP device also provided for the selective application of DI water (pH 7), a buffered acidic solution (pH 4) or a buffered basic solution (pH 9) to the planarization pad for use as a carrier/wetting liquid during the planarization process. As reflected by the data presented in FIG. 8, the coefficient of friction (COF) with a DI water carrier liquid of 50 ml/min for each of the various surface layers remained substantially constant for the duration of the test (about 600 seconds) with each material reflecting a characteristic COF between about 0.32 and 0.45.

Figure 9:
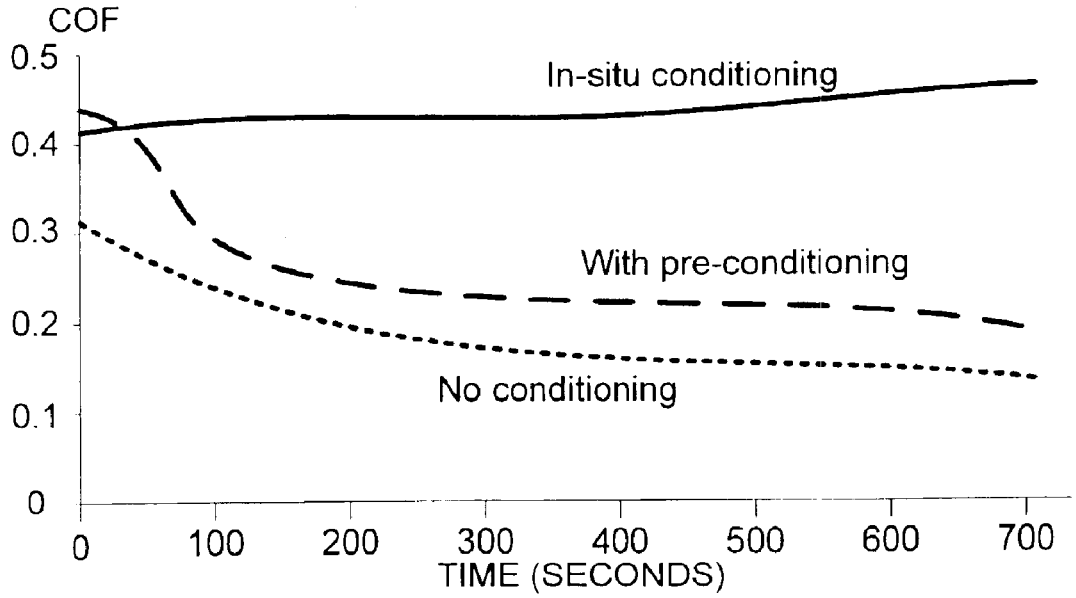
FIG. 9 is a graph illustrating the impact on coefficient of friction on silicon dioxide wafers using different planarization pad conditioning procedures.

A second COF evaluation was conducted using sample planarization pads having a layer of a fixed abrasive polyurethane foam prepared using the exemplary A1 polyurethane dispersion. Using $SiO_2$ wafers, these sample planarization pads were used to polish the wafers while receiving substantially continuous in-situ conditioning, conventional "break-in" conditioning, i.e., initial conditioning without any continuing conditioning during the polishing process, and no conditioning of the polishing surface either before or during the polishing process. As reflected by the data presented in FIG. 9, in-situ conditioning maintained or improved the COF for the duration of the test. The results for the preconditioned planarization pad, however, while exhibiting some initial improvement, exhibited continuing decreases in the COF for the duration of the test. The unconditioned planarization pad exhibited the lowest starting COF and also continued to decrease for the duration of the test, reflecting even lower COF values that the preconditioned planarization pad.

CMP of a Thermal $SiO_2$ Layer

Figure 10:
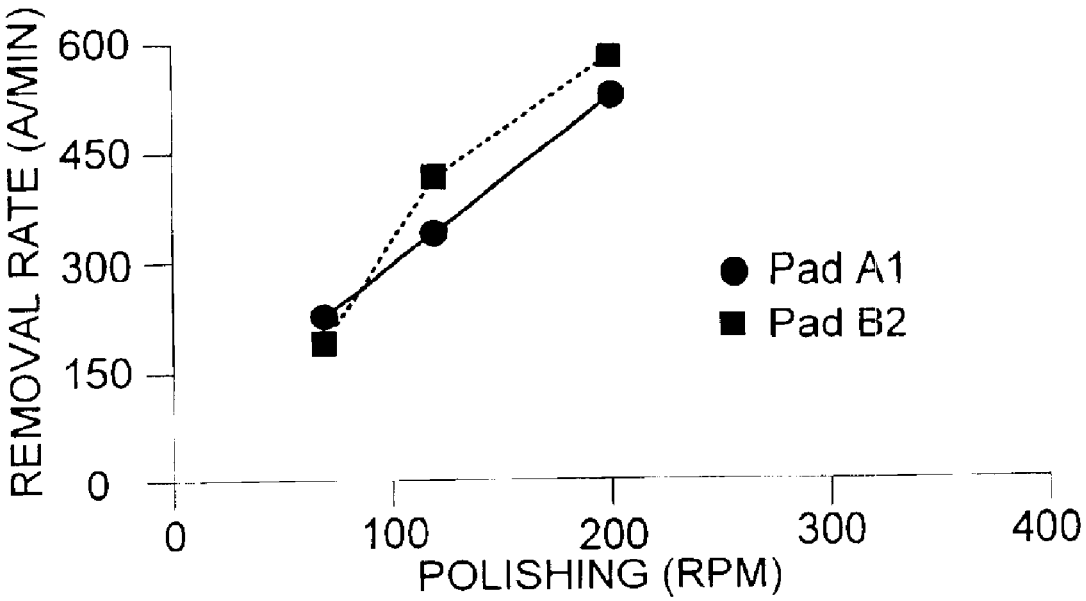
FIG. 10 is a graph illustrating the removal rate for a silicon dioxide layer at varying rpm using a planarization pad and process according to exemplary embodiments of the present invention.

A material removal rate evaluation was then conducted using sample planarization pads prepared using polyurethane dispersions as reflected in Examples A1 and B2 above. This particular evaluation was conducted with thermal $SiO_2$ wafers at rotation rates of 60, 120 and 200 rpm, under a load of about 4 psi and the application of 50 ml/minute of a D.I. water carrier liquid to the polishing surface. For the duration of this evaluation, the polishing surface was conditioned substantially continuously using the 3M disk noted above rotating at 60 rpm with a 2 psi load applied. The average material removal rate values for sample planarization pads using in-situ conditioning exhibiting a substantially linear relationship to rpm. The experimental data is reflected in FIG. 10.

Figure 11:
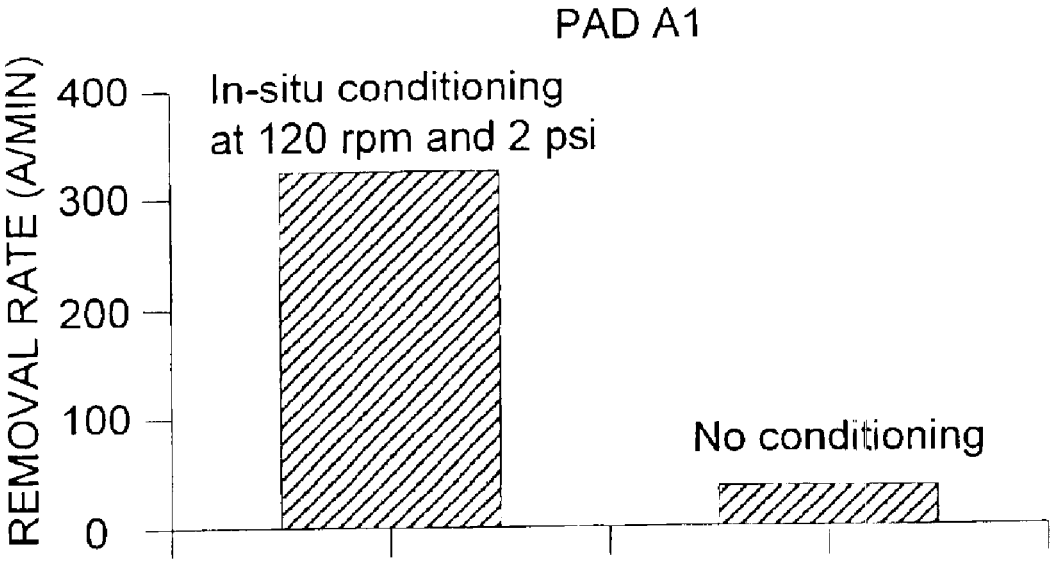
FIG. 11 is a graph illustrating the removal rate for a silicon dioxide layer using a planarization pad according to an exemplary embodiment of the invention with and without in-situ conditioning.

The material removal rate for a planarization pad manufactured using the polyurethane dispersion described in exemplary example A1 above was further evaluated using thermal $SiO_2$ wafers at 120 rpm and with 50 ml/minute of a DI water carrier liquid to the polishing surface to compare the effects of in-situ conditioning using the 3M disk noted above rotating at 60 rpm with a 2 psi load applied and no conditioning or break-in conditioning. As reflected in the data in FIG. 11, the removal rate with in-situ conditioning is approximately 10 times larger than the material removal rate achieved with the same planarization pad composition in the absence of in-situ conditioning.

CMP of a PETEOS Layer

Figure 12:
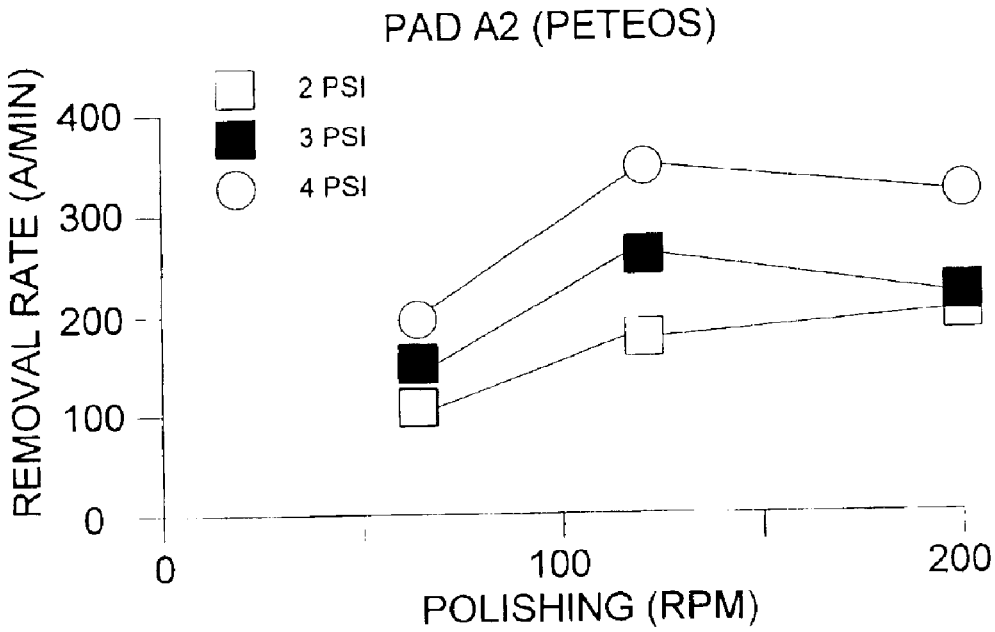
FIG. 12 is a graph illustrating the removal rate for a PETEOS layer using a planarization pad according to an exemplary embodiment of the invention.
Figure 13:
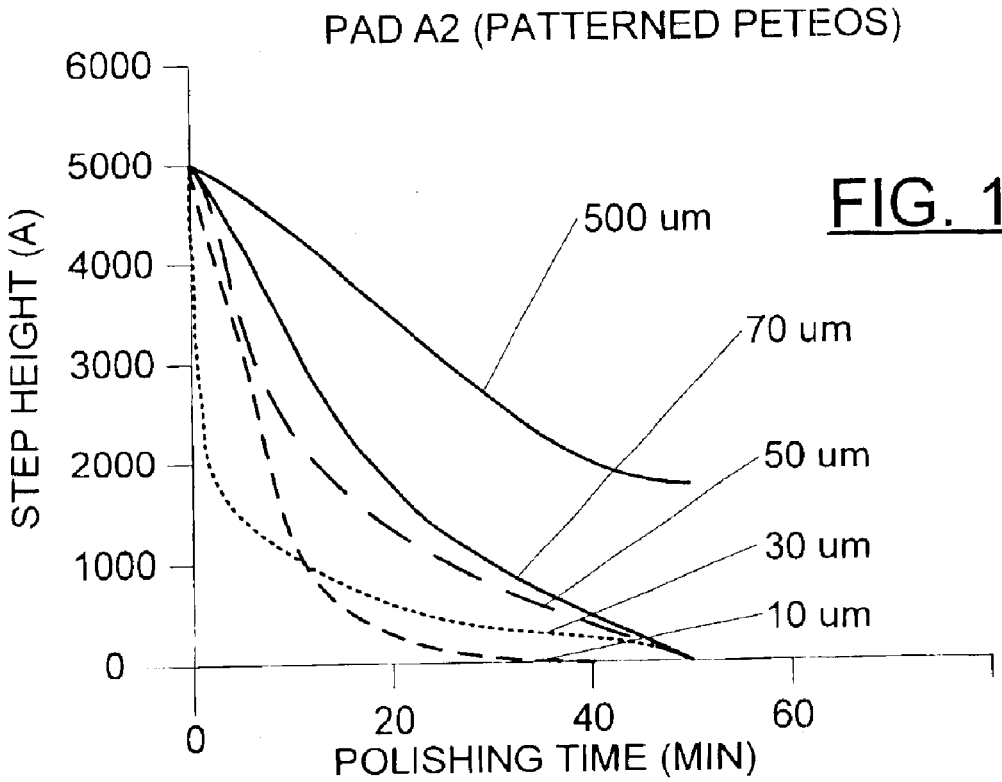
FIG. 13 is a graph illustrating the removal rate for a PETEOS layer from wafers having varying linewidths using a planarization pad according to an exemplary embodiment of the invention.

Sample planarization pads were then prepared using the polyurethane dispersions described above in exemplary examples A2 and B1 and evaluated with regard to the material removal rate on wafers having a PETEOS (Plasma Enhanced TEOS) layer. The PETEOS material removal rates were evaluated at various load pressures and rpm using an A2 composition planarization pad using the 3M disk noted above at 60 rpm and 2 psi with 50 ml/min carrier liquid (pH 7) applied to the pad surface. The data collected is presented in FIG. 12 and illustrates both an expected increase in the material removal rate with increasing load pressure and a flattening of the material removal rate curve at higher rpm values, possibly due to hydroplaning. The material removal rate for PETEOS from patterned wafers having line widths from 10 $\mu$m to 500 $\mu$m was also evaluated using a sample planarization pad prepared from the polyurethane dispersion A2 using the 3M disk noted above at 60 rpm and 2 psi with 50 ml/min of a carrier liquid (pH 7) applied to the pad surface. The data collected is presented in FIG. 13.

Figure 14:
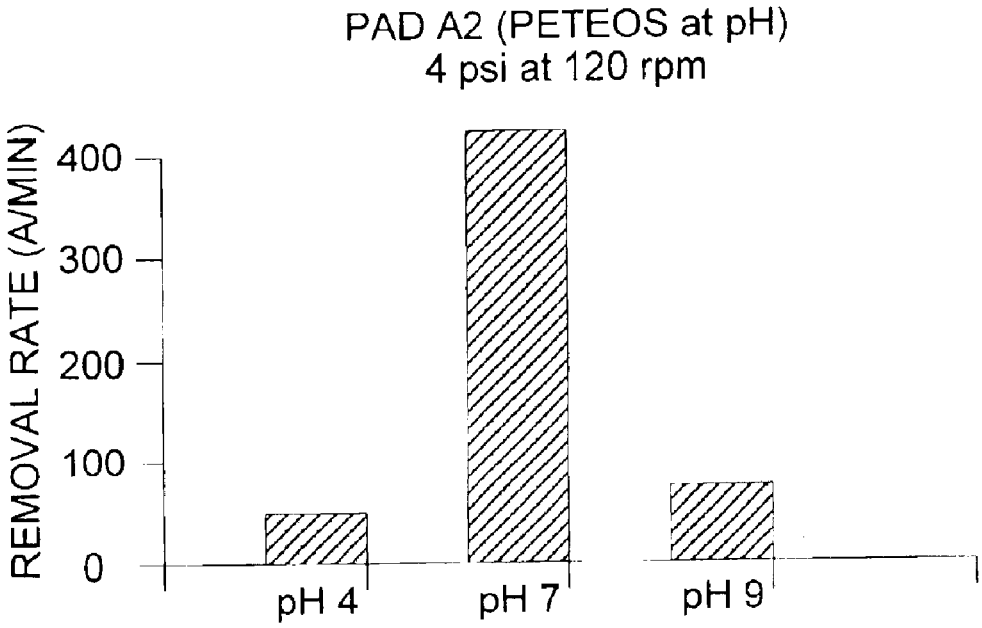
FIG. 14 is a graph illustrating the removal rate for a PETEOS layer using a planarization pad according to an exemplary embodiment of the present invention with carrier liquids of varying pH.
Figure 15:
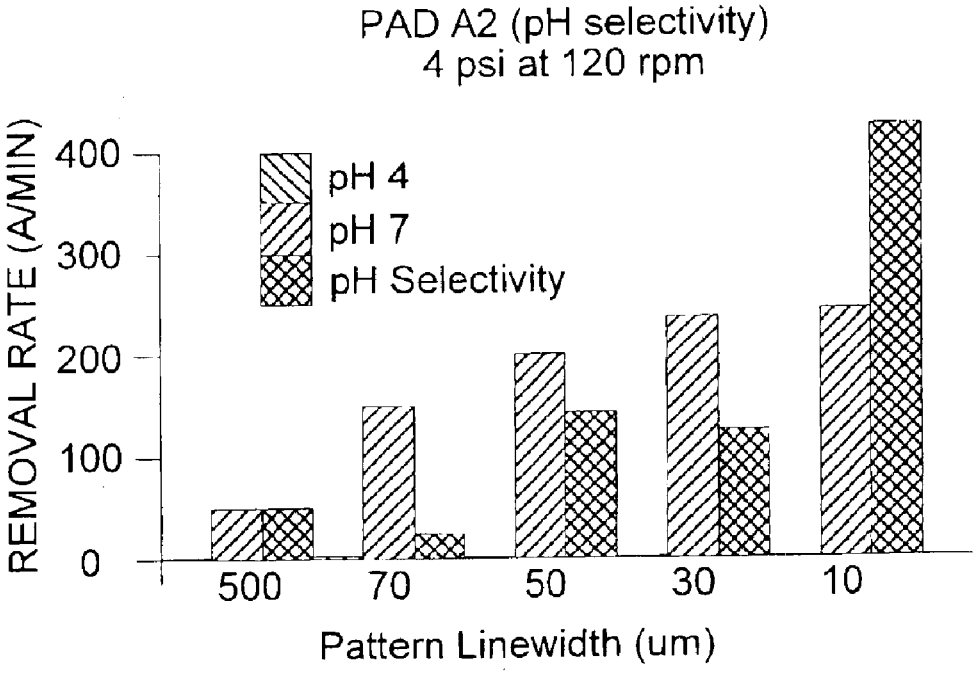
FIG. 15 is a graph illustrating the removal rate for a PETEOS layer from wafers having varying linewidths using a planarization pad according to an exemplary embodiment of the invention with carrier liquids of varying pH.

The removal rate for PETEOS layers was also evaluated using an A2 composition planarization pad at 120 rpm and a 4 psi load with in-situ conditioning using the 3M disk noted above at 60 rpm and 2 psi. In this experiment, however, the 50 ml/min of the carrier liquid was adjusted to have a pH of 4, 7 or 9, as applied to the pad surface. The data collected is presented in FIG. 14 and reflects the dramatic decrease in the removal rate for both the acidic and basic carrier liquids, the acidic carrier liquid exhibiting the most dramatic decrease. In light of this reduction in the removal rate for PETEOS layers with an acidic carrier liquid, additional trials were conducted using patterned PETEOS wafers having line widths from 10 $\mu$m to 500 $\mu$m using both pH 7 and pH 4 carrier liquids. The data collected is presented in FIG. 15 reflecting the generally increasing selectivity with more narrow line widths.

pH Control of an Oxide CMP Process

The viability of a two-step CMP process was then evaluated using a sample planarization pad prepared from polyurethane dispersion A2 at 200 rpm and a 2–4 psi load and in-situ conditioning using the 3M disk noted above at 60 rpm and 2 psi using both pH 7 and pH 4 carrier liquids. Patterned PETEOS wafers were initially planarized for 20 minutes using the pH 7 carrier liquid. The wafers were then cleaned and their surface profiles were evaluated. The wafers were then returned to the CMP device and planarized for an additional 10 minutes using the pH 4 carrier liquid. The wafers were again cleaned and their surface profiles evaluated.

Figure 16:
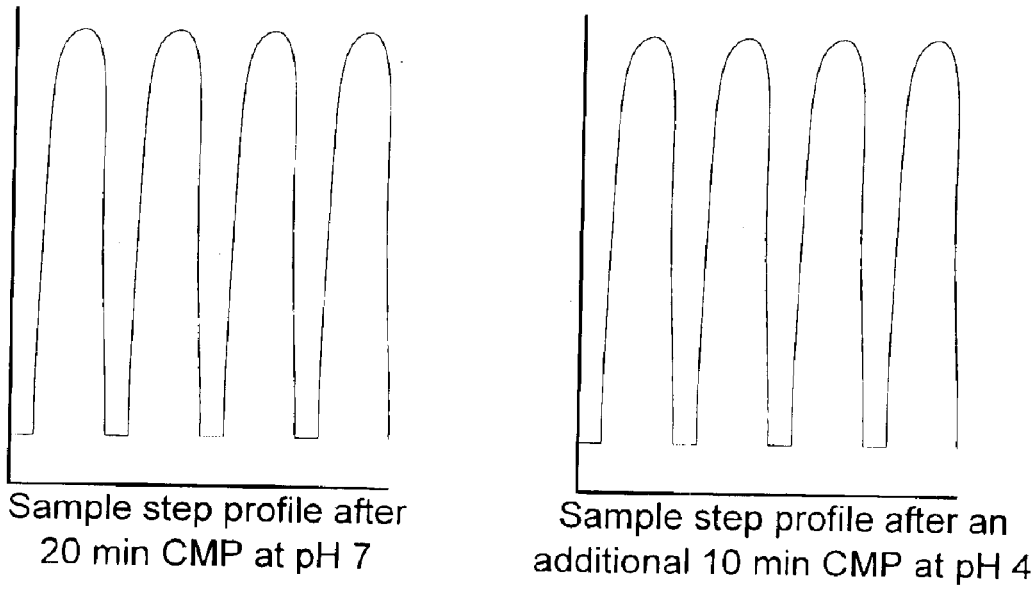
FIG. 16 is a pair of graphs illustrating the planarization of a PETEOS layer from a patterned wafer using a planarization pad according to an exemplary embodiment of the invention using a two-step planarization process.

As reflected in the step height profile curves provided in FIG. 16, the feature shape and step height of the wafers was essentially unaffected by the second planarizing process, indicating that the simple shift in the pH of the carrier liquid effectively terminated the material removal. Based on this result, controlling the pH of the carrier or wetting liquid provides another effective means of controlling the CMP process. For ceria-based fixed abrasive materials, it is anticipated that higher material rates will be achieved within a pH range of about 5 to 8, with decreases in the material removal rate exhibited at both higher and lower pH values.

This method of using pH to control the material removal rate can be extended to abrasive compositions other than ceria. In particular, fixed abrasive materials utilizing silica, for instance it is anticipated that higher material removal rates will be achieved within a pH range of about 5 to 12, with decreases in the material removal rate exhibited at both higher and lower pH values. Similarly, for fixed abrasive materials utilizing alumina for instance, it is anticipated that higher material removal rates will be achieved within a pH range of about 2 to 7, with decreases in the material removal rate exhibited at both higher pH values.

Nitride/Oxide Selectivity

Figure 17:
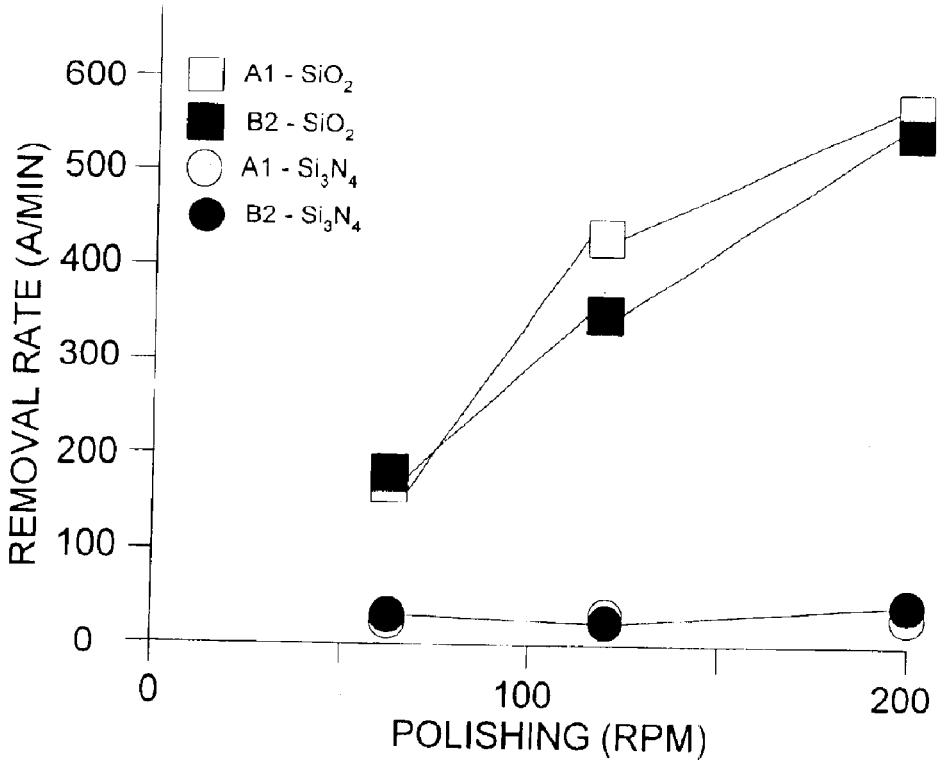
FIG. 17 is a graph illustrating the relative removal rates for silicon dioxide and silicon nitride layers using a planarization pads according to exemplary embodiments of the invention.

The nitride/oxide selectivity of planarizing pads according to the present invention were also evaluated using sample planarization pads produced from polyurethane dispersions A1 and B2 as described above. The removal rates for thermal oxide ($SiO_2$) and silicon nitride ($Si_3N_4$) were evaluated on the CPM device described above at various rpm values using about a 4 psi load while applying 50 ml/min of a neutral (pH 7) carrier or wetting liquid to the polishing surface conditioned using the 3M disk noted above at 60 rpm and 2 psi. The data collected is presented in FIG. 17 and reflects the increasing selectivity for oxide at higher rpm values for both planarizing pad compositions and the relatively rpm-independent material removal rate achieved on the nitride layer.

CMP of a Copper Layer

Sample planarizing pads were manufactured using the polyurethane dispersions described above in connection with the exemplary compositions A3. This polyurethane dispersion was then frothed using air as the frothing agent to produce a polyurethane froth having a density of about 850–1100 g/liter. A layer of the froth having a thickness of between about 1 and about 2 mm was then applied to a substrate of polycarbonate sheeting. The froth layer was then cured at 70° C. for 30 minutes, 125° C. for 30 minutes, and 150° C. for 30 minutes to produce a composite structure faced with a fixed abrasive polyurethane foam having an open cell structure, including an open surface structure, and a density of between about 0.7 and 0.9 g/cm$^3$.

Test planarization pads of approximately 4"×4" (about 10 cm×10 cm), of the composite structures having fixed abrasive polyurethane foam layers formed from polyurethane dispersion A3 were then cut from the cured fixed abrasive polymer compositions. These test planarization pads where then loaded onto a CMP device and used to polish a series of 2 inch (5 cm) wafers having a layer of Cu over a barrier layer of tantalum nitride (TaN) to evaluate both the material removal rate and the selectivity. Although TaN was used in the evaluation, other layers such as titanium nitride (TiN) or tungsten (W) compounds may be used below the primary metal layer as a barrier layer.

The CMP device utilized in this exemplary example provided for wafer and platen rotation rates from 60–200 rpm at loads of 2–4 psi. The sample pads were mounted on a SUBA-IV (Rodel) foamed polymer layer attached to the platen. Continuous in-situ diamond conditioning with a 3M diamond disk 0190-77499 3M 49860-6 100203 conditioning disk rotating at 60 rpm with a 2 psi load applied was used to release abrasive particles and polymer particles from the polishing surface of the sample planarization pads for the duration of this evaluation. The load for the polishing procedure was 4 psi at 60, 120 and 200 rpm. No break-in conditioning was applied to the sample planarization pads before the start of this evaluation.

The CMP device also provided for the selective application of DI water (pH 7) or a carrier liquid including 3 wt % hydrogen peroxide as an oxidizer at a rate of 20 ml/minute. As reflected in the data presented below in Table 4, this exemplary embodiment of a fixed abrasive pad according to the invention provided good material removal rates while maintaining good selectivity between the targeted material layer, copper, and the TaN barrier layer. As also reflected in the data presented below in Table 4, switching the carrier liquid from an oxidizing solution to a DI water rinse was sufficient to reduce dramatically the ability of the CMP process to remove the Cu layer.

TABLE 4

| Sample | RPM | Copper Removal Rate Å/min. | Selectivity Cu/TaN | Cu Removal Rate $H_2O_2$/DI |
|---|---|---|---|---|
| 1 | 60 | 872 | 10 | 75 |
| 2 | 120 | 1160 | 9 | 6 |
| 3 | 200 | 1500 | 6 | 8 |

The principles and modes of operation of this invention have been described above with reference to certain exemplary and preferred embodiments. However, it should be noted that this invention may be practiced in manners other than those specifically illustrated and described above without departing from the scope of the invention as defined in the following claims.

We claim:

1. A method of removing a material from a major surface of a substrate comprising:

applying a carrier liquid to a polishing surface of a polishing pad, the polishing pad having an open cell structure of a thermoset polymer matrix defining a plurality of interconnected cells and abrasive particles distributed throughout the polymer matrix;

causing relative motion between the substrate and the polishing pad in a plane generally parallel to the major surface of the substrate while applying a force tending to bring the major surface and the polishing surface into contact;

conditioning the polishing surface, thereby releasing free abrasive particles from the polymer matrix; and polishing the major surface of the substrate with the free abrasive particles to remove a portion of the material from the major surface of the substrate.

2. A method of removing a material from a major surface of a substrate according to claim 1, wherein:

the free abrasive particles include at least two types of particles selected from abrasive particles, composite abrasive/polymer particles and polymer particles.

3. A method of removing a material from a major surface of a substrate according to claim 1, wherein:

the free abrasive particles mix with the carrier liquid to form a planarization slurry.

4. A method of removing a material from a major surface of a substrate according to claim 3, wherein:

the planarization slurry includes at least two types of particles selected from abrasive particles, composite abrasive/polymer particles and polymer particles.

5. A method of removing a material from a major surface of a substrate according to claim 1, wherein:

applying a carrier liquid;

causing relative motion between the substrate and the polishing pad;

conditioning the polishing surface; and polishing the major surface of the substrate are performed substantially simultaneously.

6. A method of removing a material from a major surface of a substrate according to claim 5, wherein:

conditioning the polishing surface is performed substantially continuously.

7. A method of removing a material from a major surface of a substrate according to claim 1, further comprising:

substantially terminating the polishing.

8. A method of removing a material from a major surface of a substrate according to claim 7, wherein substantially terminating the polishing further comprises one or more actions selected from a group consisting of:

terminating the relative motion of the substrate and the polishing pad;

removing the substrate from contact with the polishing pad;

terminating the conditioning of the polishing surface;

modifying a pH of the carrier liquid; and reducing an oxidizer concentration of the carrier liquid.

9. A method of removing a material from a major surface of a substrate according to claim 1, wherein:

the cells have an average cell diameter, the average cell diameter being less than 250 $\mu$m.

10. A method of removing a material from a major surface of a substrate according to claim 9, wherein:

the abrasive particles have an average particle of less than about 2 $\mu$m.

11. A method of removing a material from a major surface of a substrate according to claim 10, wherein:

the abrasive particles constitute one or more particulate materials selected from a group consisting of alumina, ceria, silica, titania and zirconia.

12. A method of removing a material from a major surface of a substrate according to claim 11, wherein:

the abrasive particles have an average size of no more than 1 $\mu$m.

13. A method of removing a material from a major surface of a substrate according to claim 10, wherein:

the abrasive particles constitute between about 20 weight percent and about 70 weight percent of the polymer matrix.

14. A method of removing a material from a major surface of a substrate according to claim 13, wherein:

the polymer matrix has a density between about 0.5 and about 1.2 gram per $cm^3$, a Shore A hardness between about 30 and about 90;

a percent rebound at 5 psi of between about 30 and about 90; and a percent compressibility at 5 psi of between about 1 and 10.

15. A method of removing a material from a major surface of a substrate according to claim 14, wherein:

the polymer matrix has a density between about 0.7 and about 1.0 gram per $cm^3$;

a Shore A hardness between about 70 and about 85;

a percent rebound at 5 psi of between about 50 and about 80; and a percent compressibility at 5 psi of between about 2 and 6.

16. A method of removing a material from a major surface of a substrate according to claim 15, wherein:

the polymer matrix has a density between about 0.75 and about 0.95 gram per $cm^3$;

a Shore A hardness between about 75 and about 85;

a percent rebound at 5 psi of between about 50 and about 75; and a percent compressibility at 5 psi of between about 2 and 4.

17. A method of removing a material from a major surface of a substrate according to claim 1, wherein conditioning the polishing surface further comprises:

placing a conditioning surface of a conditioning element adjacent the polishing surface; and inducing relative motion between the conditioning element and the polishing pad in a plane generally parallel to the polishing surface while applying a force tending to bring the conditioning surface and the polishing surface into contact.

18. A method of removing a material from a major surface of a substrate according to claim 17, wherein conditioning the polishing surface further comprises:

removing from about 0.01 to about 0.5 $\mu$m of the polymer matrix from the polishing surface for each substrate polished.

19. A method of removing oxide from a major surface of a semiconductor substrate comprising:

applying a carrier liquid to the polishing surface of a polishing pad, the polishing pad having an open cell structure of a thermoset polymer matrix defining a plurality of interconnected cells and abrasive particles distributed throughout the polymer matrix, and the carrier liquid having a pH of between about 5 and about 8;

causing relative motion between the substrate and the polishing pad in a plane generally parallel to the oxide layer while applying a force tending to bring the oxide layer and the polishing surface into contact;

conditioning the polishing surface, thereby releasing abrasive particles from the polymer matrix to form free abrasive particles;

combining the carrier liquid and the free abrasive particles to form a planarizing slurry; and polishing the oxide with the planarizing slurry to remove a portion of the oxide from the substrate.

20. A method of removing oxide from a major surface of a semiconductor according to claim 19, wherein:

the abrasive particles include ceria and have an average particle size of less than 1.5 $\mu$m.

21. A method of removing oxide from a major surface of a semiconductor according to claim 20, wherein:

substantially all of the abrasive particles are ceria and have an average particle size of less than about 1 $\mu$m.

22. A method of removing oxide from a major surface of a semiconductor according to claim 21, wherein:

the abrasive particles have an average particle size of less than 0.6 $\mu$m.

23. A method of removing oxide from a major surface of a semiconductor according to claim 19, further comprising:

removing nitride from the major surface of the semiconductor at a first rate wherein the oxide is removed from the major surface at a second rate and further wherein the second rate is at least 4 times the first rate.

24. A method of removing oxide from a major surface of a semiconductor according to claim 23, wherein:

the second rate is at least 6 times the first rate.

25. A method of removing oxide from a major surface of a semiconductor according to claim 19, further comprising:

slowing the polishing by reducing the pH of the carrier liquid, thereby reducing a rate at which oxide is removed from the major surface by at least about 70%.

26. A method of removing oxide from a major surface of a semiconductor according to claim 25, wherein:

the pH of the carrier liquid is reduced to 4 or less and the rate at which oxide is removed from the major surface is reduced by at least about 85%.

27. A method of removing oxide from a major surface of a semiconductor according to claim 19, further comprising:

slowing the polishing by increasing the pH of the carrier liquid, thereby reducing a rate at which oxide is removed from the major surface by at least about 50%.

28. A method of removing oxide from a major surface of a semiconductor according to claim 27, wherein:

the pH of the carrier liquid is increased to 10 or more and the rate at which oxide is removed from the major surface is reduced by at least about 75%.

29. A method of removing metal from a major surface of a semiconductor substrate comprising:

applying a carrier liquid to the polishing surface of a polishing pad, the polishing pad having an open cell structure of a thermoset polymer matrix defining a plurality of interconnected cells and abrasive particles distributed throughout the polymer matrix, and the carrier liquid having an oxidizer concentration;

causing relative motion between the substrate and the polishing pad in a plane generally parallel to the oxide layer while applying a force tending to bring the metal layer and the polishing surface into contact;

conditioning the polishing surface, thereby releasing free abrasive particles from the polymer matrix;

combining the carrier liquid and the free abrasive particles to form a planarizing slurry; and polishing the metal with the planarizing slurry to remove a portion of the metal from the substrate.

30. A method of removing metal from a major surface of a semiconductor according to claim 29, wherein:

the oxidizer concentration in the carrier liquid is between about 1 wt % and about 10 wt %.

31. A method of removing oxide from a major surface of a semiconductor according to claim 30, wherein:

the oxidizer includes hydrogen peroxide.

32. A method of removing metal from a major surface of a semiconductor according to claim 31, wherein:

the abrasive particles include ceria and have an average particle size of less than 2 $\mu$m.

33. A method of removing metal from a major surface of a semiconductor according to claim 29, further comprising:

removing a barrier layer from the major surface of the semiconductor at a first rate wherein the metal is removed from the major surface at a second rate and further wherein the second rate is at least 4 times the first rate.

34. A method of removing metal from a major surface of a semiconductor according to claim 33, wherein:

the second rate is at least 6 times the first rate.

35. A method of removing metal from a major surface of a semiconductor according to claim 33, wherein:

the metal includes copper and the barrier layer includes a material selected from a group consisting of tantalum nitride (TaN) and titanium nitride (TiN).

36. A method of removing metal from a major surface of a semiconductor according to claim 35, wherein:

the oxidizer includes between about 2 wt % and about 5 wt % hydrogen peroxide.

37. A method of removing metal from a major surface of a semiconductor according to claim 36, wherein:

the carrier liquid includes at least one component selected from a group consisting of acids, bases, chelating agents and surfactants.

38. A method of removing metal from a major surface of a semiconductor according to claim 29, further comprising:

slowing the polishing by reducing the oxidizer concentration in the carrier liquid, thereby reducing a rate at which metal is removed from the major surface by at least about 70%.

39. A method of removing metal from a major surface of a semiconductor according to claim 38, wherein:

the oxidizer concentration of the carrier liquid is reduced to less than 0.25 wt % and the rate at which metal is removed from the major surface is reduced by at least about 85%.

* * * * *